US007974565B2

(12) United States Patent
Hozumi et al.

(10) Patent No.: US 7,974,565 B2
(45) Date of Patent: Jul. 5, 2011

(54) CLEANING DEVICE FOR IMAGE FORMING APPARATUS AND PROCESS CARTRIDGE PROVIDED THEREWITH

(75) Inventors: Yoshiki Hozumi, Kanagawa (JP); Kazuhiko Watanabe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/559,903

(22) Filed: Sep. 15, 2009

(65) Prior Publication Data

US 2010/0067945 A1 Mar. 18, 2010

(30) Foreign Application Priority Data

Sep. 16, 2008 (JP) ..... 2008-237009

(51) Int. Cl.
*G03G 21/00* (2006.01)

(52) U.S. Cl. ..... 399/351; 399/123; 15/256.51

(58) Field of Classification Search ..... 399/123, 399/343, 345, 350, 351; 15/256.5, 256.51, 15/256.52

See application file for complete search history.

(56) References Cited

U.S. PATENT DOCUMENTS

| | | | | |
|---|---|---|---|---|
| 4,768,062 | A * | 8/1988 | Tanzawa et al. | 399/351 |
| 5,946,530 | A * | 8/1999 | Tsuji et al. | 399/103 |
| 2007/0098435 | A1 * | 5/2007 | Kitagawa et al. | 399/100 |
| 2008/0063448 | A1 | 3/2008 | Hozumi et al. | |

FOREIGN PATENT DOCUMENTS

| | | |
|---|---|---|
| JP | 60-198574 | 10/1985 |
| JP | 2006-178164 | 7/2006 |
| JP | 2008-96965 | 4/2008 |

OTHER PUBLICATIONS

U.S. Appl. No. 12/558,934, filed Sep. 14, 2009, Watanabe, et al.

* cited by examiner

*Primary Examiner* — David P Porta
*Assistant Examiner* — Benjamin Schmitt
(74) *Attorney, Agent, or Firm* — Oblon, Spivak, McClelland, Maier & Neustadt, L.L.P.

(57) ABSTRACT

The present invention relates to a cleaning device that allows the obtaining of a high level of removal performance while reducing wear between a plate-shaped elastic member and a cleaning-targeted surface moving member, while also being able to stably maintain the contact status between the surface moving member and the plate-shaped elastic member, and an image forming apparatus and a process cartridge provided therewith. A plate holder retains a blade via warping restriction means, a bearing and a support shaft engage at an engaging portion with a degree of freedom due to the presence of a gap therebetween, the plate holder is able to be displaced relative to a frame of the device body, the support shaft is arranged on the device body in the direction of surface movement of a photosensitive element downstream a normal line of the surface of the photosensitive element at a portion contacted by the blade, and a foreign object infiltration prevention member is provided on the bearing or the support shaft of the engaging portion to prevent entry of foreign objects into the gap.

18 Claims, 11 Drawing Sheets

FIG. 17

| TONER DIAMETER (AVERAGE) | | AVERAGE ROUNDNESS | SHAPE FACTOR | |
|---|---|---|---|---|
| VOLUME PARTICLE DIAMETER (μm) | Dv/Dn | | SF-1 | SF-2 |
| 2.4 | 1.14 | 0.985 | 141 | 135 |

FIG. 18

| TONER USED | DEVICE USED | BEARING PORTION SOILING | | | CLEANING PERFORMANCE EVALUATION | | |
|---|---|---|---|---|---|---|---|
| | | INITIAL | AFTER 5K SHEETS | AFTER 10K SHEETS | INITIAL | AFTER 5K SHEETS | AFTER 10K SHEETS |
| TONER 1 | PRIOR ART DEVICE 1 | ○ | – | – | × | – | – |
| | PRIOR ART DEVICE 2 | ○ | △ | × | ○ | ○ | △ |
| | EXAMPLE DEVICE 1 | ○ | ○ | ○ | ○ | ○ | ○ |
| | EXAMPLE DEVICE 2 | ○ | △ | △ | ○ | ○ | ○ |

CLEANING DEVICE FOR IMAGE FORMING APPARATUS AND PROCESS CARTRIDGE PROVIDED THEREWITH

BACKGROUND OF THE INVENTION

1. Field of the Invention

The present invention relates to an image forming apparatus such as a photocopier, facsimile machine or printer, and more particularly, to a cleaning device for removing unnecessary adhered substances adhered to the surface of an image carrier, which is a surface moving member, provided in these image forming apparatuses having a cleaning member such as a cleaning blade that removes the adhered substances by contacting the surface moving member, and to a process cartridge provided with this cleaning device.

2. Description of the Related Art

Conventionally, this type of image forming apparatus is frequently provided with a surface moving member such as a photosensitive drum, an image carrier such as an intermediate transfer belt, and a surface transport member such as a recording material conveyor belt that transports a recording material such as paper. In general, since various problems occur if unnecessary adhered substances adhere to the surface of such a surface moving member, cleaning means is required for removing the adhered substances from the surface of the surface moving member. Due to its simple configuration and superior performance in removing adhered substances, a blade-type cleaning device is widely used for this cleaning means, which removes adhered substances from the surface of a surface moving member by pressing a cleaning blade composed of an elastic member such as polyurethane rubber against the surface of the surface moving member.

Known examples of this type of cleaning device of the cleaning blade type include those disclosed in the patent publications indicated below:

Japanese Patent Application Laid-open No. S60-198574,

Japanese Patent Application Laid-open No. 2006-178164,

Japanese Patent Application Laid-open No. 2008-096965, and

Japanese Patent Application Laid-open No. 2008-233319.

More specifically, known examples of cleaning devices of the cleaning blade type include those employing a trailing method as disclosed in the Japanese Patent Application Laid-open No. S60-198574, and those employing a counter method as disclosed in the Japanese Patent Application Laid-open No. 2006-178164. In general, since the counter method is able to increase the contact pressure of the cleaning blade on the surface of the surface moving member as compared with the trailing method, the counter method has the advantage of higher performance in removing adhered substances on the surface of the surface moving member as compared with the trailing method. Thus, in cases requiring a high level of performance in removing adhered substances, a cleaning device of the counter type is employed. In particular, recent image forming apparatuses of the electronic photography type frequently use a spherical toner having a small particle diameter, and particularly a polymer toner, and a high level of removal performance is required to remove these types of adhered substances in the form of toner. Consequently, since cleaning devices of the trailing type have inadequate performance for removing such adhered substances, cleaning devices of the counter type are employed for this purpose.

On the other hand, in a conventional cleaning device of the counter type, if the cleaning blade is pressed against the surface of the surface moving member with an excessively large force to obtain a high level of adhered substance removal performance, the surface moving member and the cleaning blade itself become worn, thereby resulting in the problem of shortening the service life of the surface moving member and the cleaning blade.

In order to solve such problems, a cleaning device disclosed in the Japanese Patent Application Laid-open No. 2008-096965 is known. In this cleaning device, warping of the cleaning blade, which occurs when a cleaning blade that is long in the direction of width of the surface moving member is pressed against the surface of the surface moving member, is restricted by a warping restrict ion member. As a result, the length of a contact portion in the direction of surface movement of the surface moving member between the cleaning blade and the surface of the surface moving member (to be referred to as the "contact width") can be shortened as compared with a cleaning device in which warping of the cleaning blade is not restricted. Namely, in a conventional cleaning device of the counter type in which warping of the cleaning blade is not restricted, warping of the cleaning blade and deformation of the cleaning blade itself occur as a result of the contact edge of the cleaning blade pressing against the surface of the surface moving member. The contact width becomes longer the greater the warping of the cleaning blade, and also becomes longer the greater the deformation of the cleaning blade itself. In this cleaning device, since warping of the cleaning blade is restricted by a warping restriction member, the contact width is primarily only determined by deformation of the cleaning blade itself. Thus, in this cleaning device, contact width can be shortened in comparison with a conventional cleaning device of the counter type in which warping of the cleaning blade is not restricted. Since wear of the surface moving member and cleaning blade decrease the shorter the contact width for the same contact pressure, in this cleaning device, wear of the surface moving member and cleaning blade can be inhibited as compared with conventional cleaning devices of the counter type in which warping of the cleaning blade is not restricted.

However, in an image forming apparatus, the positional relationship between the surface moving member and the cleaning blade may shift due to production tolerances or member deformation attributable to environmental fluctuations within the image forming apparatus body. In this cleaning device of Japanese Patent Application Laid-open No. 2008-096965, if the positional relationship between the surface moving member and the cleaning blade shifts, there is the risk of being unable to suitably maintain the contact status between the surface moving member and the cleaning blade in the lengthwise direction of the cleaning blade. In the most extreme cases, locations may be formed where contact is not made in the lengthwise direction. In a configuration in which warping of the cleaning blade is not restricted, even if a shift occurs in the above-mentioned positional relationship, the contact status was able to be maintained due to the shift in the positional relationship being absorbed as a result of restoration of warping of the cleaning blade. However, in a configuration in which warping of the cleaning blade is restricted as in this cleaning device, since there is no warping of the cleaning blade, correction of a shift in the positional relationship goes virtually uncorrected even if such a shift occurs. Accordingly, when employing a configuration in which warping of the cleaning blade is restricted as in this cleaning device for the cleaning means of the surface moving member, unless the cleaning device is provided with a configuration that absorbs and corrects any shifts in the above-mentioned positional relationship, the above-mentioned contact status of the contact portion can no longer be maintained over time due a shift in the positional relationship. Consequently, the problem results in which locations occur where cleaning of the surface moving member is not carried out adequately.

Thus, in order to solve such problems, in a cleaning device disclosed in the Japanese Patent Application Laid-open No. 2008-233319, engaged means provided in a retaining member that retains a cleaning blade in the manner described above, and engaging means supported by the device body, engage such that a gap is formed between the engaging means and the engaged means when in an engaged state. Due to the presence of this gap, the engaging means and the engaged means engage with a degree of freedom, and the retaining member can be displaced relative to the device body. As a result, shifts in the positional relationships between each member due to production tolerances or environmental fluctuations can be corrected by displacement of the retaining member relative to the device body, thereby making it possible to maintain contact between the surface moving member and the cleaning blade. Thus, the occurrence of uneven contact in the lengthwise direction of the cleaning blade can be inhibited, and the contact status between the cleaning blade and the surface of the surface moving member to be maintained over time.

However, in the case of a configuration like that of a cleaning device described in the above-mentioned prior application in which a gap is formed between engaged means of a retaining member and engaging means on the device body when in an engaged state, if foreign objects such as toner or lubricant become entrapped in the gap, there is the risk of the effectiveness of the gap being lost. Namely, the degree of freedom in engagement between the engaging means and the engaged means obtained due to the presence of the gap is lost, the retaining member is no longer able to be displaced relative to the device body, or production tolerances or shifts in positional relationships can no longer be corrected, thereby resulting in the risk of being unable to inhibit the occurrence of uneven contact in the lengthwise direction of the cleaning blade.

SUMMARY OF THE INVENTION

It is an object of the present invention to provide a cleaning device capable of favorably removing various unnecessary adhered substances on the surface of a surface moving member.

It is another object of the present invention to provide a cleaning device capable of reliably maintaining the contact status between a surface moving member and a cleaning blade over time.

It is still another object of the present invention to provide a cleaning device capable of reducing wear of a surface moving member and a cleaning blade. What is claimed is:

In an aspect of the present invention, a cleaning device removes adhered substances on a surface of a surface moving member. The cleaning device comprises a long, plate-shaped elastic member; a retaining member that retains the plate-shaped elastic member; an engaging device provided on the retaining member; an engaged device for engaging with the engaging device, the engaged device being supported by a device body; a warping restriction device for restricting warping of the plate-shaped elastic member that occurs as a result of the plate-shaped elastic member pressing against the surface of the surface moving member; and a foreign object infiltration prevention device that prevents entry of foreign objects into a gap between the engaging device and the engaged device. The engaging device and the engaged device engage in a direction of surface movement of the surface moving member downstream a normal line of a portion where the plate-shaped elastic member contacts the surface of a cleaning-targeted surface moving member. The retaining member retains the plate-shaped elastic member through the warping restriction device, and the plate-shaped elastic member removes adhered substances on the surface of the surface moving member by pressing against the surface of the surface moving member, with the plate-shaped elastic member being pressed against the surface of the surface moving member such that one side of the plate-shaped elastic member extending in a lengthwise direction thereof is perpendicular to a direction of surface movement of the surface moving member. A degree of freedom is provided between the engaging device and the engaged device by forming a gap therebetween while the engaging device and the engaged device are engaged so that the degree of freedom enables the retaining member to be displaced relative to the device body.

In another aspect of the present invention, a cleaning device removes adhered substances on a surface of a surface moving member. The cleaning device comprises a long, plate-shaped elastic member; a retaining member that retains the plate-shaped elastic member; an engaging device provided on the retaining member; an engaged device for engaging with the engaging device, the engaged device being supported by a device body; a warping restriction device for restricting warping of the plate-shaped elastic member that occurs as a result of the plate-shaped elastic member pressing against the surface of the surface moving member; and a foreign object storage device, provided in the engaging device or the engaged device, for ensuring a degree of freedom between the engaging device and the engaged device and storing foreign objects that have entered a gap between the engaging device the engaged device. The engaging device and the engaged device engage in a direction of surface movement of the surface moving member downstream a normal line of a portion where the plate-shaped elastic member contacts the surface of the cleaning-targeted surface moving member. The retaining member retains the plate-shaped elastic member through the warping restriction device, and the plate-shaped elastic member removes adhered substances on the surface of the surface moving member by pressing against the surface of the surface moving member such that one side of the plate-shaped elastic member extending in a lengthwise direction thereof is perpendicular to the direction of surface movement of the surface moving member. The degree of freedom is provided between the engaging device and the engaged device by forming a gap between the engaging device and the engaged device, with the engaging device and the engaged device being engaged so that the degree of freedom enables the retaining member to be displaced relative to the device body.

In another aspect of the present invention, a process cartridge is configured removably with respect to a body of an image forming apparatus that ultimately transfers an image formed on an image carrier, which is a surface moving member, to a recording material, and integrally supports at least the image carrier and cleaning device for removing unnecessary adhered substances adhered to the image carrier. The cleaning device comprises a long, plate-shaped elastic member; a retaining member that retains the plate-shaped elastic member; an engaging device provided on the retaining member; an engaged device for engaging with the engaging device, the engaged device being supported by a device body; a warping restriction device for restricting warping of the plate-shaped elastic member that occurs as a result of the plate-shaped elastic member pressing against the surface of the surface moving member; and a foreign object infiltration prevention device that prevents entry of foreign objects into a gap between the engaging device and the engaged device. The engaging device and the engaged device engage in a direction of surface movement of the surface moving member downstream a normal line of a portion where the plate-shaped elastic member contacts the surface of a cleaning-targeted surface moving member. The retaining member retains the plate-shaped elastic member through the warping restriction device, and the plate-shaped elastic member removes adhered substances on the surface of the surface moving member by pressing against the surface of the surface moving member, with the plate-shaped elastic member being pressed against the surface of the surface moving member such that one side of the plate-shaped elastic member extending in a lengthwise direction thereof is perpendicular to a direction of surface movement of the surface moving member. A degree of freedom is provided between the engaging device and the engaged device by forming a gap therebetween while the engaging device and the engaged device are engaged so that the degree of freedom enables the retaining member to be displaced relative to the device body.

In another aspect of the present invention, a process cartridge is configured removably with respect to a body of an image forming apparatus that ultimately transfers an image formed on an image carrier, which is a surface moving member, to a recording material, and integrally supports at least the image carrier and cleaning means for removing unnecessary adhered substances adhered to the image carrier. The cleaning device comprises a long, plate-shaped elastic member; a retaining member that retains the plate-shaped elastic member; an engaging device provided on the retaining member; an engaged device for engaging with the engaging device, the engaged means being supported by a device body; a warping restriction device for restricting warping of the plate-shaped elastic member that occurs as a result of the plate-shaped elastic member pressing against the surface of the surface moving member; and a foreign object storage device, provided in the engaging device or the engaged device, for ensuring a degree of freedom between the engaging device and the engaged device and storing foreign objects that have entered a gap between the engaging device the engaged device. The engaging device and the engaged device engage in a direction of surface movement of the surface moving member downstream a normal line of a portion where the plate-shaped elastic member contacts the surface of the cleaning-targeted surface moving member. The retaining member retains the plate-shaped elastic member through the warping restriction device, and the plate-shaped elastic member removes adhered substances on the surface of the surface moving member by pressing against the surface of the surface moving member such that one side of the plate-shaped elastic member extending in a lengthwise direction thereof is perpendicular to the direction of surface movement of the surface moving member. The degree of freedom is provided between the engaging device and the engaged device by forming a gap between the engaging device and the engaged device, with the engaging device and the engaged device being engaged so that the degree of freedom enables the retaining member to be displaced relative to the device body.

In another aspect of the present invention, an image forming apparatus ultimately transfers an image formed on a surface moving member to a recording material, and is provided with a cleaning device for removing adhered substances adhered to the surface moving member. The cleaning device comprises a long, plate-shaped elastic member; a retaining member that retains the plate-shaped elastic member; an engaging device provided on the retaining member; an engaged device for engaging with the engaging device, the engaged device being supported by a device body; a warping restriction device for restricting warping of the plate-shaped elastic member that occurs as a result of the plate-shaped elastic member pressing against the surface of the surface moving member; and a foreign object infiltration prevention device that prevents entry of foreign objects into a gap between the engaging device and the engaged device. The engaging device and the engaged device engage in a direction of surface movement of the surface moving member downstream a normal line of a portion where the plate-shaped elastic member contacts the surface of a cleaning-targeted surface moving member. The retaining member retains the plate-shaped elastic member through the warping restriction device, and the plate-shaped elastic member removes adhered substances on the surface of the surface moving member by pressing against the surface of the surface moving member, with the plate-shaped elastic member being pressed against the surface of the surface moving member such that one side of the plate-shaped elastic member extending in a lengthwise direction thereof is perpendicular to a direction of surface movement of the surface moving member. A degree of freedom is provided between the engaging device and the engaged device by forming a gap therebetween while the engaging device and the engaged device are engaged so that the degree of freedom enables the retaining member to be displaced relative to the device body.

In another aspect of the present invention, an image forming apparatus ultimately transfers an image formed on a surface moving member to a recording material, and is provided with a cleaning device for removing adhered substances adhered to the surface moving member. The cleaning device comprises a long, plate-shaped elastic member; a retaining member that retains the plate-shaped elastic member; an engaging device provided on the retaining member; an engaged device for engaging with the engaging device. The engaged device being supported by a device body; a warping restriction device for restricting warping of the plate-shaped elastic member that occurs as a result of the plate-shaped elastic member pressing against the surface of the surface moving member; and a foreign object storage device, provided in the engaging device or the engaged device, for ensuring a degree of freedom between the engaging device and the engaged device and storing foreign objects that have entered a gap between the engaging device the engaged device. The engaging device and the engaged device engage in a direction of surface movement of the surface moving member downstream a normal line of a portion where the plate-shaped elastic member contacts the surface of the cleaning-targeted surface moving member. The retaining member retains the plate-shaped elastic member through the warping restriction device, and the plate-shaped elastic member removes adhered substances on the surface of the surface moving member by pressing against the surface of the surface moving member such that one side of the plate-shaped elastic member extending in a lengthwise direction thereof is perpendicular to the direction of surface movement of the surface moving member. The degree of freedom is provided between the engaging device and the engaged device by forming a gap between the engaging device and the engaged device, with the engaging device and the engaged device being engaged so that the degree of freedom enables the retaining member to be displaced relative to the device body.

BRIEF DESCRIPTION OF THE DRAWINGS

The above and other objects, features and advantages of the present invention will become more apparent from the following detailed description taken with the accompanying drawings, in which:

FIG. 17 is a table indicating the physical properties of a Toner 1; and

FIG. 18 is a table indicating the results of a running test of the Toner 1.

DESCRIPTION OF THE PREFERRED EMBODIMENT(S)

The following provides an explanation of conventional cleaning devices of the present invention, and particularly cleaning devices of the trailing type and the counter type, with reference to the drawings prior to providing an explanation of the present invention.

Figure 1A:
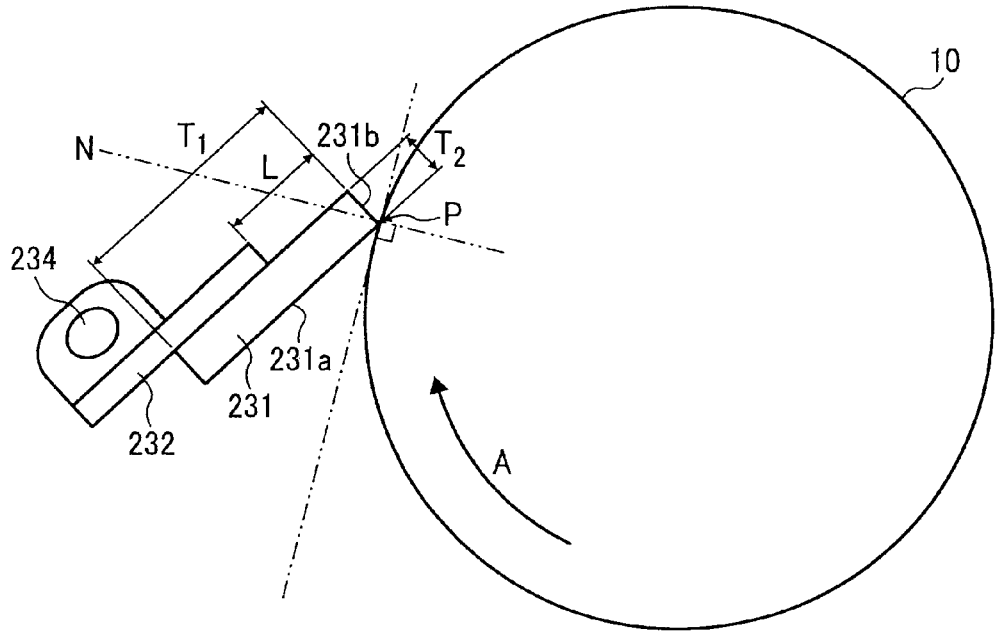
FIG. 1A PRIOR ART
FIG. 1A is a drawing for explaining a cleaning device of the trailing type of the prior art.

FIG. 1A shows the configuration of a conventional cleaning device of the trailing type.

In this cleaning device, a configuration is employed in which a cleaning blade 231, which is composed of a long elastic material along the direction of the axis of rotation of a drum-like photosensitive element (surface moving member) 10 perpendicular to a direction of surface movement A of the photosensitive element 10, is pressed against the surface of the photosensitive element 10 at one edge thereof extending in the lengthwise direction thereof (to be referred to as the "contact edge"). In a trailing type of cleaning device, the cleaning blade 231 is held by a retaining member in the form of a cleaning blade holder 232 supported by a device body upstream in the direction of movement of the photosensitive element surface from a normal line N of a contact portion P on the surface of the photosensitive element contacted by the contact edge of the cleaning blade 231. In the present description, a "trailing type" refers to that in which a supporting portion 234, which supports a device body of a retaining member that retains an elastic member, is located upstream in the direction of surface movement of a surface moving member from a normal line of a contact portion on the surface of the surface moving member contacted by a contact edge of the elastic member.

Figure 1B:
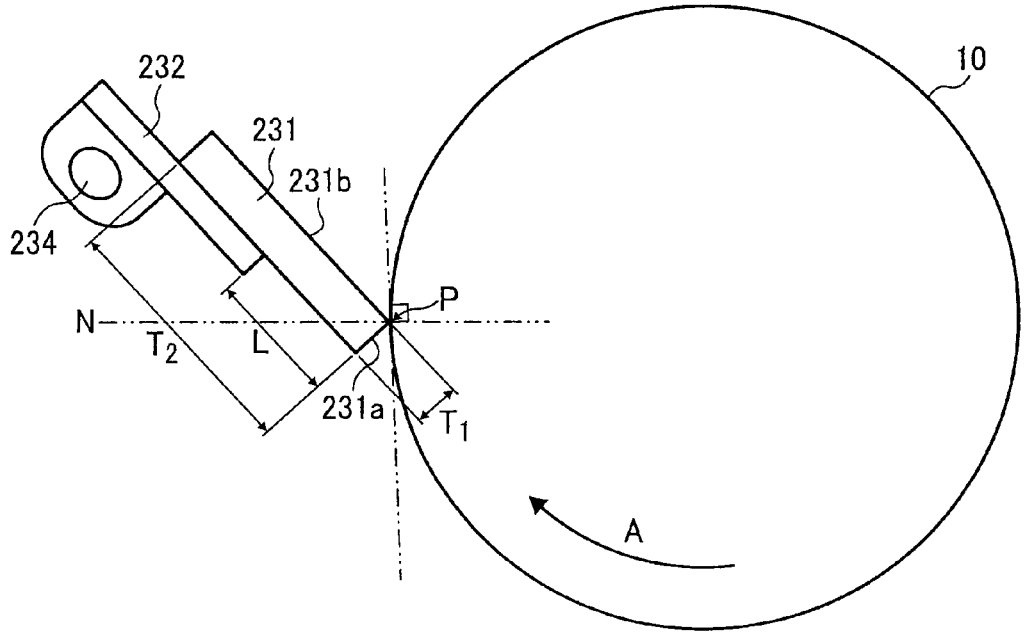
FIG. 1B PRIOR ART
FIG. 1B is a drawing for explaining a cleaning device of the counter type of the prior art.

FIG. 1B shows the configuration of a conventional cleaning device of the counter type.

This cleaning device also employs a configuration in which the cleaning blade 231, which is composed of a long elastic member in the direction of the axis of rotation of a photosensitive element perpendicular to the surface movement direction A of the photosensitive element, is pressed against the surface of the photosensitive element 10 at a contact edge that extends in the lengthwise direction thereof. In a counter type of cleaning device, the cleaning blade 231 is held by the cleaning blade holder 232 supported by the device body downstream in the direction of movement of the photosensitive element surface from the normal line N of the contact portion P on the surface of the photosensitive element contacted by the contact edge of the cleaning blade 231. In the present description, a "counter type" refers to that in which the supporting portion 234, which supports a device body of a retaining member that retains an elastic member, is located downstream in the direction of surface movement of a surface moving member from a normal line of a contact portion on the surface of the surface moving member contacted by a contact edge of the elastic member.

The following provides a detailed explanation of these trailing type and counter type cleaning devices. In the case of the trailing type, when the cleaning blade 231 is pressed with a large force to increase contact pressure, the cleaning blade 231 ends up warping. A bellying phenomenon occurs in which the upstream side 231*a* of the cleaning blade, which is located on the upstream side in the direction of photosensitive element surface movement relative to the contact edge of the cleaning blade 231, ends up contacting the surface of the photosensitive element. When this bellying phenomenon occurs, since the contact surface area between the cleaning blade 231 and the surface of the photosensitive element suddenly increases, the contact pressure conversely becomes small even if the cleaning blade 231 is pressed with a large force, and removal performance decreases.

In contrast, in the case of the counter type, since frictional force acts in opposition to warping of the cleaning blade 231 even if the cleaning blade 231 is pressed with a large force to increase contact force, there is little warping of the cleaning blade 231. Consequently, there is little occurrence of bellying phenomenon even if the cleaning blade 231 is pressed with a large force, and a large pressing force can be imparted relative to a small contact surface area. Accordingly, high contact pressure can be realized and a high level of removal performance is obtained. However, there are several problems with this type of cleaning device that remain unsolved as previously described.

The following provides an explanation of an embodiment of the present invention that is applied to an image forming apparatus in the form of a printer.

Figure 2:
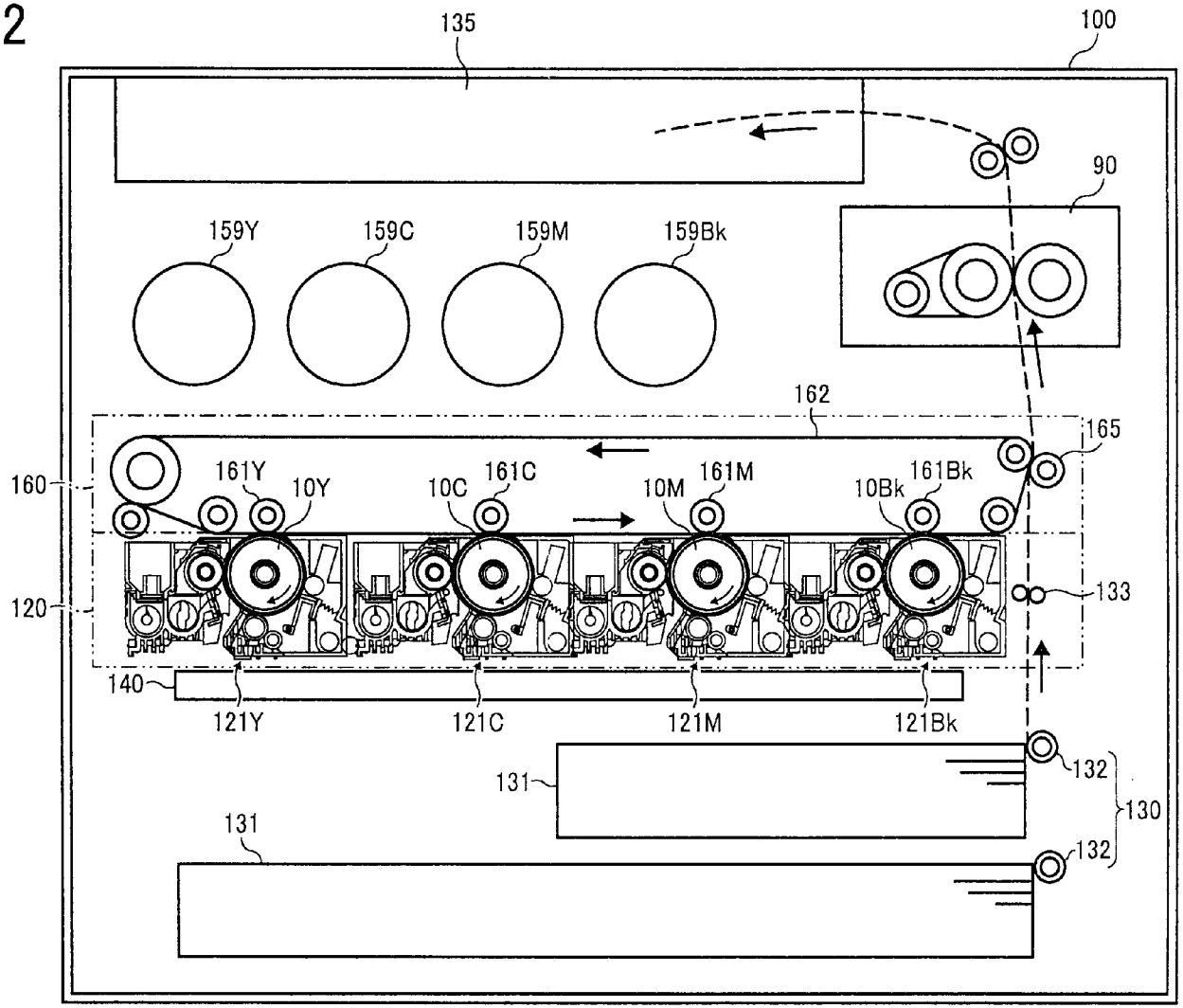
FIG. 2 is a drawing showing the general configuration of a printer of a first embodiment of the present invention.

FIG. 2 shows the general configuration of an image forming apparatus in the form of a printer 100 in the present embodiment.

The printer 100 forms full-color images, and is primarily composed of an image forming unit 120, a secondary transfer device 160 and a paper feeding unit 130. Furthermore, in the following explanation, the suffixes Y, C, M and Bk indicate yellow, cyan, magenta and black members, respectively.

The image forming unit 120 is provided with a yellow toner process cartridge 121Y, a cyan toner process cartridge 121C, a magenta toner process cartridge 121M and a black toner process cartridge 121Bk in order moving from left to right in the drawing. These process cartridges 121Y, 121C, 121M and 121Bk are arranged in a row in roughly the horizontal direction.

The secondary transfer device 160 is primarily composed of an endless intermediate transfer belt 162, in the form of an intermediate transfer body suspended on a plurality of support rollers, primary transfer rollers 161Y, 161C, 161M and 161Bk, and a secondary transfer roller 165. The intermediate transfer belt 162 is arranged along the direction of surface movement of latent image carriers in the form of drum-like photosensitive elements 10Y, 10C, 10M and 10Bk, which are surface moving members in the form of image carriers provided in each of the process cartridges 121Y, 121C, 121M and 121Bk, above each of the process cartridges. The surface of the intermediate transfer belt 162 moves synchronous to surface movement of the photosensitive elements 10Y, 10C, 10M and 10Bk. In addition, each of the primary transfer rollers 161Y, 161C, 161M and 161Bk are arranged on the side of the inner peripheral surface of the intermediate transfer belt 162, and the outer peripheral surfaces located on the lower side of the intermediate transfer belt 162 are weakly contacted with the outer peripheral surfaces of each of the photosensitive elements 10Y, 10C, 10M and 10Bk by these primary transfer rollers.

Toner images are formed on each of the photosensitive elements 10Y, 10C, 10M and 10Bk, and the configuration and operation by which the toner images are transferred to the intermediate transfer belt 162 are substantially the same for each of the process cartridges 121Y, 121C, 121M and 121Bk. However, a shaking mechanism not shown, which vertically shakes the primary transfer rollers 161Y, 161C and 161M corresponding to the three color process cartridges 121Y, 121C and 121M, is provided for the primary transfer rollers 161Y, 161C and 161M. The shaking mechanism operates so as not to allow the intermediate transfer belt 162 to contact the photosensitive elements 10Y, 10C and 10M when color images are not formed.

The secondary transfer device 160 is composed so as to be able to be removed from the body of the printer 100. More specifically, the secondary transfer device 160 can be removed from the body of the printer 100 by opening a front cover (not shown) towards the front of the drawing in FIG. 2 that covers the image forming unit 120 of the printer 100, and then sliding the secondary transfer unit 160 towards the front from the back of the drawing of FIG. 2. The reverse procedure of the removal procedure is carried out when installing the secondary transfer unit 160 in the body of the printer 100.

Furthermore, an intermediate transfer belt cleaning device for removing adhered substances such as residual toner following secondary transfer adhered to the intermediate transfer belt 162 may be provided on the downstream side in the direction of surface movement from the secondary transfer roller 165 of the intermediate transfer belt 162 and on the upstream side of the process cartridge 121Y. In the case of providing an intermediate transfer belt cleaning device, a configuration similar to a photosensitive element cleaning device to be described later may be employed for this intermediate transfer belt cleaning device. In addition, the intermediate transfer belt cleaning device may be provided in the secondary transfer device 160 in a state of being integrally supported with the intermediate transfer belt 162.

Toner cartridges 159Y, 159C, 159M and 159Bk, corresponding to each of the process cartridges 121Y, 121C, 121M and 121Bk, are arranged in a row in roughly the horizontal direction above the secondary transfer device 160.

In addition, an exposure device 140, which forms an electrostatic latent image by radiating laser light onto the surfaces of the charged photosensitive elements 10Y, 10C, 10M and 10Bk, is arranged below the process cartridges 121Y, 121C, 121M and 121Bk.

In addition, the paper feeding unit 130 is arranged below the exposure device 140. Paper cassettes 131, which store a recording material in the form of transfer paper, and paper feeding rollers 132 are provided in the paper feeding unit 130, and the paper feeding unit 130 feeds transfer paper at a prescribed timing towards a secondary transfer nip unit between the intermediate transfer belt 162 and the secondary transfer roller 165 after passing between a pair of resist rollers 133.

In addition, a fixing device 90 is arranged on the downstream side of the secondary transfer nip unit in the direction of transfer paper transport, and a discharged paper storage unit 135, which stores discharge rollers and discharged transfer paper, is arranged on the downstream side of the fixing device 90 in the direction of transfer paper transport.

Figure 3:
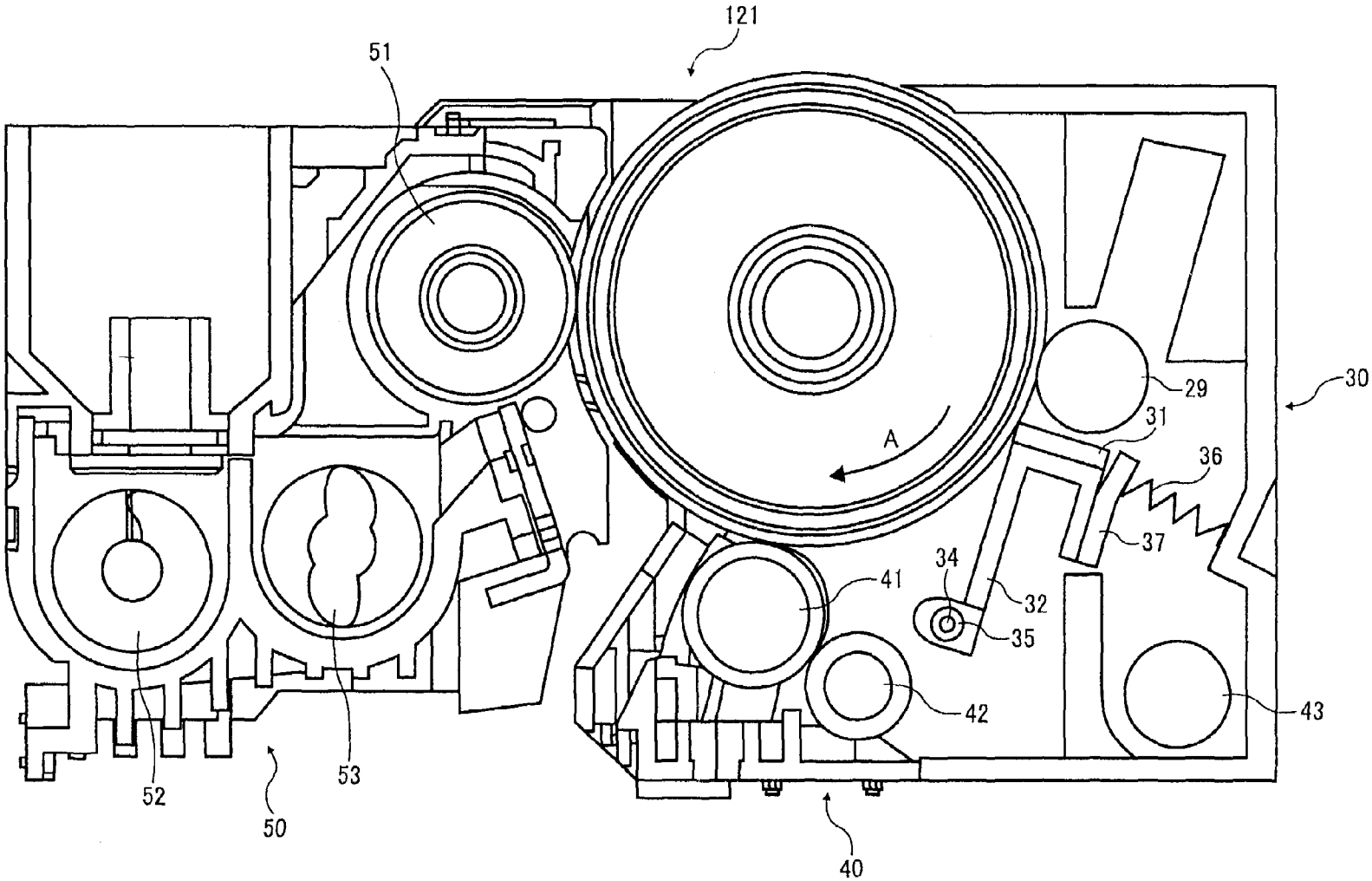
FIG. 3 is a drawing showing the general configuration of a process cartridge provided in the printer of FIG. 2.

FIG. 3 shows the general configuration of a process cartridge 121 provided in the printer 100.

Furthermore, since the configuration of each process cartridge 121 is nearly the same, the suffixes Y, C, M and Bk used to indicate color are omitted from the following explanation, and configuration and operation are explained for a process cartridge 121.

The process cartridge 121 is provided with a photosensitive element 10, a cleaning device 30 arranged on the periphery of the photosensitive element 10, a charging device 40 and a developing device 50.

The cleaning device 30 separates and removes unnecessary adhered substances such as residual transfer toner on the surface of the photosensitive element 10 by pressing one edge extending in the lengthwise direction (contact edge) of an elastic member that is long in the direction of the axis of rotation of the photosensitive element 10 in the form of a cleaning blade (to be referred to as blade 31) against the surface of the photosensitive element 10. The adhered substances are then driven off the photosensitive element 10 by a brush roller 29 from the upstream side of the photosensitive element 10 in the direction of surface movement at the contact location of the blade 31 towards a discharge screw 43, and then discharged outside the cleaning device 30 by the discharge screw 43. In the present embodiment, polyurethane rubber is used for the material of the blade 31 due to its superior wear properties with respect to the photosensitive element 10 and its own wear resistance as compared with other elastic materials. Electrically conductive PET is used for the fiber material of the brush roller 29. An explanation of the details of the cleaning device 30 will be provided hereinafter.

Furthermore, a lubricant application device may also be provided in the cleaning device 30. A device composed of a solid lubricant, a lubricant supporting member that supports the solid lubricant and the brush roller 29 that rotates while contacting both the solid lubricant and the photosensitive element 10 can be used for the lubricant application device. In this type of lubricant application device, powdered lubricant brushed off of the solid lubricant by the brush roller 29 is coated onto the surface of the photosensitive element 10 by the brush roller. In addition, a coating blade may also be arranged on the downstream side in the direction of photosensitive element surface movement from the brush roller 29 so as to contact the surface of the photosensitive element 10. This coating blade is supported by a coating blade holder in a state in which the leading end thereof contacts the surface of the photosensitive element 10, and is for evenly spreading lubricant coated onto the surface of the photosensitive element 10 and making the thickness thereof uniform.

The charging device 40 is mainly composed of a charging roller 41 that is arranged so as to contact the photosensitive element 10, and a charging roller cleaner 42, that rotates while contacting the charging roller 41.

The developing device 50 forms visual images of the electrostatic latent images by supplying toner to the surface of the photosensitive element 10, and is provided with a developer carrier in the form of a developing roller 51 that holds a developer on the surface thereof. The developing device 50 is mainly composed of this developing roller 51, an agitation screw 52, which transports the developer while agitating the developer stored in a developer storage unit, and a supply screw 53 that transports the agitated developer while supplying to the developing roller 51.

The four process cartridges 121 having the configuration described above can be respectively and independently removed and replaced by a service technician or user. In addition, the photosensitive element 10, the charging device 40, the developing device 50 and the cleaning device 30 of the process cartridge 121 when removed from the printer 100 are composed to be able to be respectively and independently replaced with new devices. Furthermore, the process cartridge 121 may also be provided with a waste toner tank that recovers residual transfer toner recovered in the cleaning device 30. In this case, convenience is further improved by employing a configuration in which the waste toner tank in the process cartridge 121 can also be independently removed and replaced.

The following provides an explanation of operation of the printer 100.

Once a print command has been received, the photosensitive elements 10 are first rotated in the direction of arrow A in the drawing, and the surfaces of the photosensitive elements 10 are evenly charged to a prescribed polarity by the charging roller 41 of the charging device 40. The exposure device 140 than radiates laser beam light, for example, which has been optically modulated corresponding to input color image data, for each color onto the charged photosensitive elements 10, resulting in the formation of electrostatic latent images of each color on the surfaces of the photosensitive elements 10. Developer of each color is then supplied from the developing roller 51 of each color of developing unit 50 to each electrostatic latent image, each color of electrostatic latent image is developed with each color of developer, and a visible image is formed by forming a toner image corresponding to each color. Next, a transfer electric field is formed by applying a transfer voltage of a polarity opposite that of the toner image to the primary transfer rollers 161 followed by forming a primary transfer nip by weakly contacting the intermediate transfer belt 162 with the primary transfer rollers 161. As a result of these actions, the toner images on each of the photosensitive elements 10 are efficiently primarily transferred to the intermediate transfer belt 162. Toner images of each color formed on each photosensitive element 10 are then transferred so as to mutually overlap on the intermediate transfer belt 162 resulting in the formation of a layered toner image.

For the layered toner image primarily transferred onto the intermediate transfer belt 162, transfer paper stored in the paper cassettes 131 is transported at a prescribed timing over the paper feeding rollers 132 and the pair of resist rollers 133. The layered toner image primarily transferred onto the intermediate transfer belt 162 is then transferred to the transfer paper by forming a transfer electric field by applying a transfer voltage of a polarity opposite that of the toner image to the secondary transfer roller 165. The layered toner image secondarily transferred onto the transfer paper is sent to the fixing device 90 where it is fixed with heat and pressure. The transfer paper on which the toner image has been fixed is discharged to the discharged paper storage unit 135 by the discharge rollers where it is stacked therein. On the other hand, residual transfer toner remaining on each photosensitive element 10 following primary transfer is brushed off and removed by the blade 31 of each cleaning device 30.

Next, a detailed explanation is provided of the cleaning device 30, which is a characteristic portion of the present invention.

Figure 4:
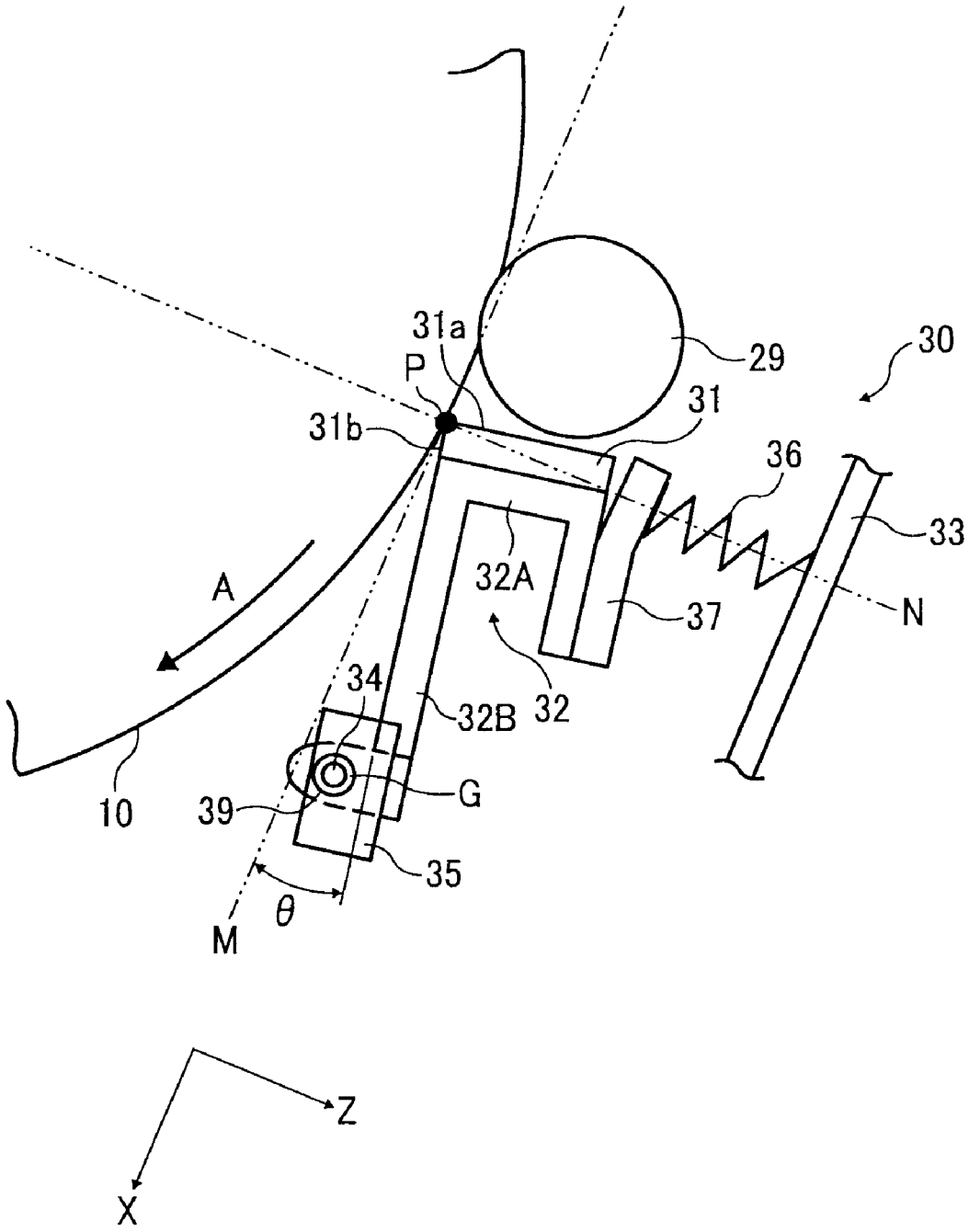
FIG. 4 is a drawing of the essential portions of a cleaning device of the printer of FIG. 2 as viewed from the direction of the axis of rotation of a photosensitive element.

FIG. 4 is a drawing of the essential portions of the cleaning device 30 as viewed from the direction of the axis of rotation of the photosensitive elements 10 (Y direction).

Figure 5:
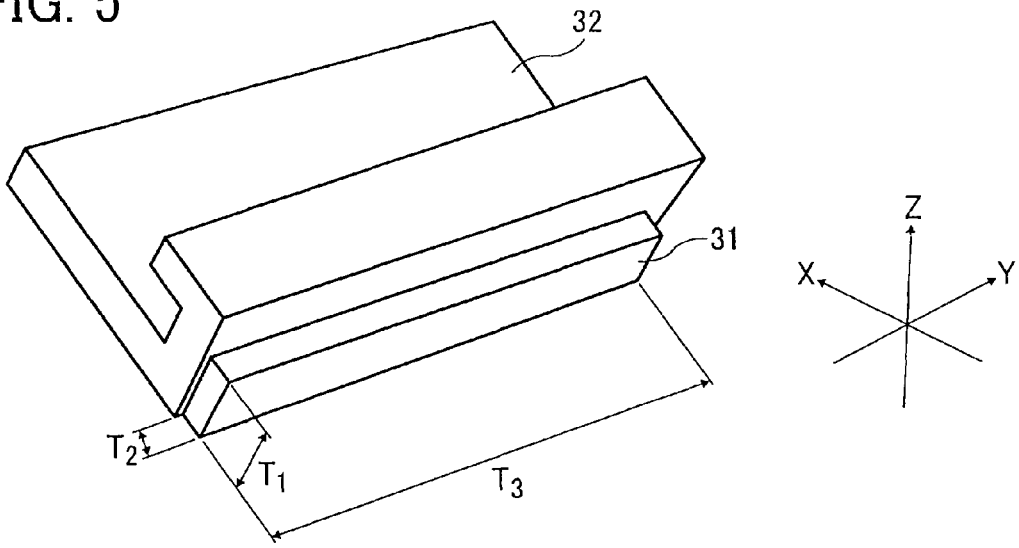
FIG. 5 is a perspective view showing the configuration of the essential portions of the cleaning device of FIG. 4.

FIG. 5 is a perspective view showing the essential portions of the cleaning device 30.

The cleaning device 30 of the present embodiment is mainly provided with a plate-shaped elastic member in the form of the blade 31, and an elastic body retaining member in the form of a blade holder 32 formed from a rigid material that holds the blade 31.

The blade holder 32 has a roughly U-shaped cross-sectional shape when severed along a cross-section that is perpendicular to the direction of the axis of rotation of the photosensitive element 10, and the blade 31 is attached to the upper surface of a holder horizontal portion 32A (surface facing the upstream side in the direction of photosensitive element surface movement) that extends in roughly the horizontal direction (direction from left to right in FIGS. 1 and 3). Furthermore, the blade holder 32 is not limited to an integrated structure as shown in FIG. 4, but rather may employ a structure composed of two pieces. In addition, the blade 31 may be attached to the blade holder 32 by adhesion, hot melting or other method. In the present embodiment, the holder horizontal portion 32A of the blade holder 32 functions as a warping restriction member that restricts warping by the blade 31.

Figure 6:
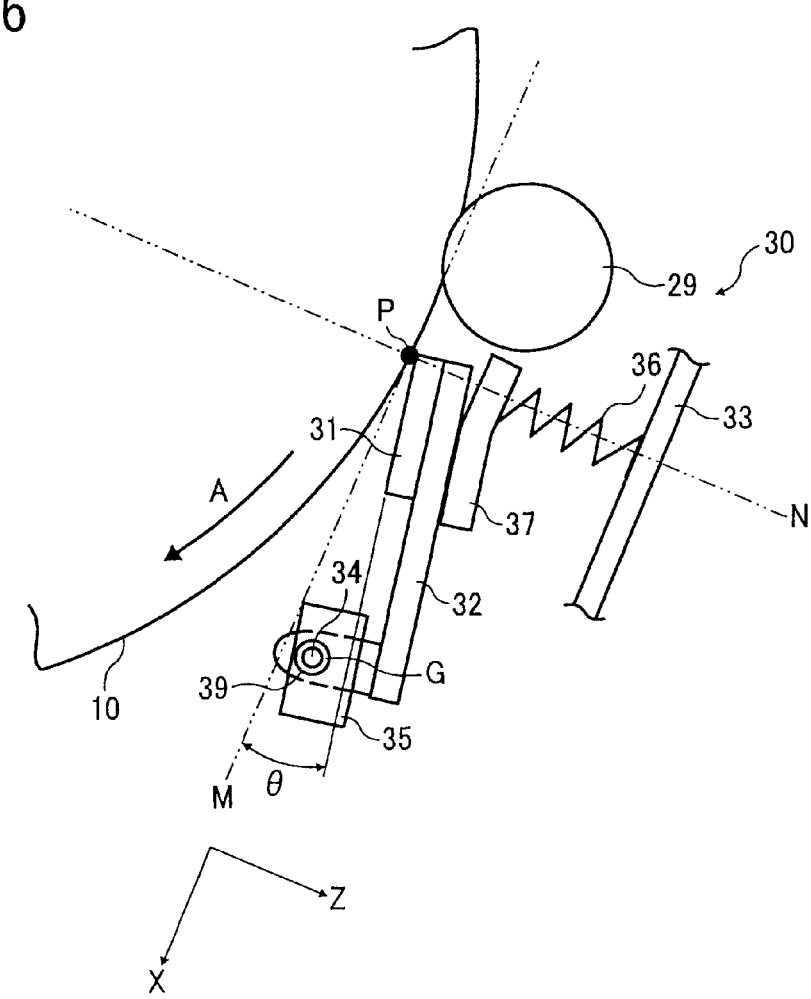
FIG. 6 is a drawing showing a different configuration from the present embodiment in which a blade is retained so that the free length of the blade is approximately zero.

In addition, the blade 31 can also be held on a surface of the plate-shaped blade holder 32 that opposes the surface of the photosensitive element 10 to enable the blade holder 32 to function as a warping restriction member in the manner of the cleaning device 30 shown in FIG. 6. In this case, since the contact width of the contact portion of the blade 31 with the photosensitive element 10 can be increased slightly as a result of the blade 31 being pulled more in the case the photosensitive element 10 has rotated in comparison with the configuration of FIG. 4, surface pressure decreases resulting in a slight decrease in cleaning performance. However, surface pressure adequate for cleaning can still be applied.

The blade holder 32 also has a holder vertical portion 32B that extends in roughly the vertical direction (vertical direction in FIGS. 4 and 3). A support shaft 34 is provided on the lower end of this holder vertical portion 32B (end on the downstream side in the direction of photosensitive element surface movement), and rotatably engages with a bearing 35 provided in a frame 33 of the cleaning device 30. As a result, the blade holder 32 is rotatably and pivotally supported by device body. At this time, the same parts or different parts may be used for the frame 33 and the bearing 35.

In the present embodiment, a configuration is employed in which the support shaft 34 provided in the blade holder 32 is retained by the bearing 35 provided in the frame 33 of the cleaning device 30 on the downstream side in the direction of photosensitive element surface movement from the normal line N of the contact portion P on the surface of the photosensitive element 10 that is contacted by the contact edge of the blade 31. Namely, the cleaning device 30 of the present embodiment employs a counter method, and the long portion of the blade holder 32 in the form of the holder vertical portion 32B functions as a retaining member.

In the cleaning device 30 of the present embodiment, a configuration is employed in which the blade holder 32 is retained with a degree of freedom so as to be able to be displayed relative to the frame 33 of the cleaning device 30.

Here, an explanation is provided of the method by which the blade holder 32 is retained.

As shown in FIG. 4, the method for retaining the blade holder 32 on the frame 33 employs a configuration consisting of engaging means in the form of the support shaft 34 provided on the blade holder 32, and engaged means in the form of the bearing 35 provided in the frame 33, and play occurs during engagement between the support shaft 34 and the bearing 35.

A shaft hole of the bearing 35 is in the form of a round hole or a slot having a long axis in a direction roughly parallel to the normal line N. Alternatively, the support shaft 34 can also be made to be displaceable relative to the bearing 35 by using an elastic body for the bearing 35.

The cleaning device 30 of the present embodiment employs a round hole for the shaft hole of the bearing 35 in the form of a configuration that allows play to occur during engagement between the support shaft 34 and the bearing 35.

Figure 7:
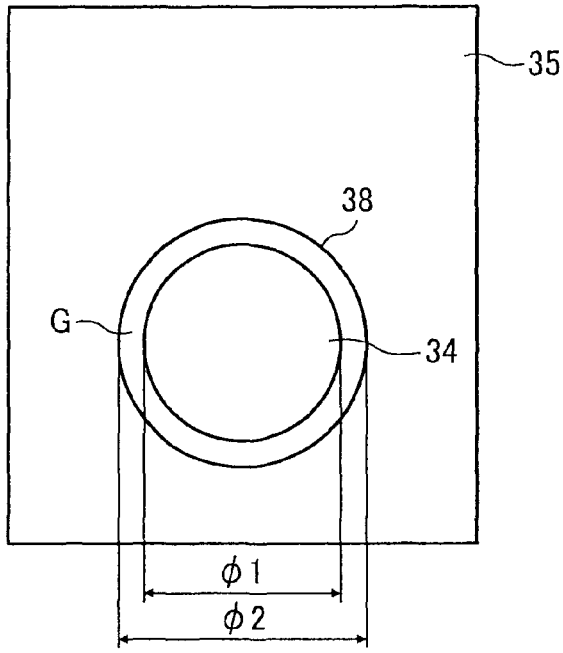
FIG. 7 is a drawing showing an engaging portion of a bearing and a support shaft of a cleaning device as claimed in the present embodiment.

FIG. 7 shows an engaging portion of a bearing 35 and the support shaft 34 provided in the frame 33 of the cleaning device 30 of the present embodiment.

In the cleaning device 30 of the present embodiment as shown in FIG. 7, the support shaft 34 is a stainless steel rod, and the diameter of this rod in the form of $\phi$1 is 15±0.05 mm. Thus, although the diameter of the shaft hole of the bearing 35 in the form of $\phi$2 is normally 15.10±0.05 mm so as not to allow the occurrence of excessive play during engagement of the support shaft 34 and the bearing 35, in the present embodiment, the diameter $\phi$2 of the shaft hole in the form of round hole 38 is 15.60±0.05 mm. This is because, when the dimensional accuracy of the blade 31, the blade holder 32, the bearing 35 and the like, the installation accuracy between the blade holder 32 and the blade 31, and the tolerance of variations in positional accuracy and the like between the cleaning device 30 and the photosensitive element 10 are totaled, the total tolerance is ±0.5 mm, and the diameter $\phi$2 of the round hole 38 of the bearing 35 is made to be larger than the diameter $\phi$1 of the support shaft 34 by the amount of that tolerance. In other words, in the present embodiment, play is intentionally imparted by forming a gap G in the engaging portion of the support shaft 34 and the bearing 35 as shown in FIG. 7.

In the cleaning device 30 of the present embodiment, warping of the blade 31 is restricted when the blade 31 is pressed against the photosensitive element 10 since the blade 31 is retained by the blade holder 32 and has a free length of approximately zero. This inhibits an excessive increase in the contact surface area between the elastic member in the form of the blade 31 and the surface moving member in the form of the photosensitive element 10, which is advantageous for cleaning since a high surface pressure can be maintained. On the other hand, in cases of poor component accuracy or assembly accuracy and the like, it becomes difficult to uniformly apply pressure in the lengthwise direction of the photosensitive element 10 due to the absence of degree of freedom. Namely, in a configuration in which warping of the blade 31 is inhibited as in the cleaning device 30 of the present embodiment, since there is no degree of freedom for deformation of the blade 31 along the surface of the photosensitive element 10, it becomes difficult to apply uniform pressure so that the blade 31 uniformly contacts the photosensitive element 10 in the lengthwise direction thereof. In such a configuration, in the case the support shaft 34 and the bearing 35 are engaged without allowing a degree of freedom as in the prior art, when there is a tolerance in the manner described above, the distance between the blade 31 and the photosensitive element 10 on the side of one of the bearings 35 in the lengthwise direction of the blade 31, and the distance between the blade 31 and the photosensitive element 10 on the side of the other bearing 35 differ, thereby preventing contact status between the photosensitive element 10 and the blade 31 in the aforementioned lengthwise direction from being suitably maintained. In extreme cases, locations can occur where the photosensitive element 10 and the blade 31 do not make contact in the lengthwise direction.

Consequently, in the cleaning device 30 of the present embodiment, as a result of the support shaft 34 and the bearing 35 engaging with a degree of freedom by forming the gap G between the support shaft 34 and the bearing 35, in the state in which the blade 31 is pressed against the photosensitive element 10, engagement between the support shaft 34 and the bearing 35 for both bearings 35 differs by the amount of the aforementioned tolerance, or in other words, the location of the support shaft 34 relative to the bearing 35 differs (position that differs in the radial direction of a support receiver). In this manner, since the engaging state between the support shaft 34 and the bearing 35 changes enabling the blade 31 to be displaced relative to the photosensitive element 10 even if tolerance occurs as described above, the contact status between the photosensitive element 10 and the blade 31 in the aforementioned lengthwise direction can be maintained. Namely, the contact edge of the blade 31 is able to contact the surface of the photosensitive element 10 in the lengthwise direction without the occurrence of partial contact. As a result, cleaning performance improves and wear resistance of the blade 31 and the photosensitive element 10 can be improved by reducing unnecessary pressure.

Figure 8:
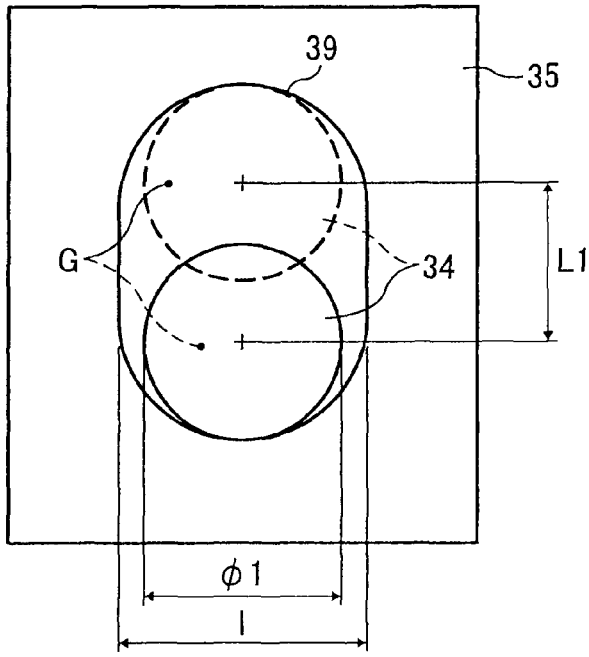
FIG. 8 is a drawing showing an engaging portion of a bearing and a support shaft of a cleaning device having a different configuration from the present embodiment.

FIG. 8 shows another configuration of an engaging portion of the bearing 35 and the support shaft 34 able to be applied to the cleaning device 30.

The shaft hole of the bearing 35 may be a slot 39 having a long axis in the direction of the normal line N as shown in FIG. 8. For example, in the case the diameter $\phi$1 of the support shaft 34 is 15±0.05 mm, the length l of the short axis of the slot 39 becomes 15.10±0.05 mm. In addition, when the total tolerance as determined in the manner described above is ±0.5 mm, the long axis of the slot 39 is made to be 15.65±0.05 mm based on the diameter of the support shaft 34 and an interval L1 between the center of the support shaft 34 when the support shaft 34 is at the highest position (when at the position indicated with the broken line in FIG. 8) and the center of the support shaft 34 when the support shaft 34 is at the lowest position (when at the position indicated with the solid line in FIG. 8) so that the interval L1 becomes 0.65±0.05 mm obtained by adding $\alpha$ to the aforementioned tolerance. Furthermore, the support shaft 34 engages in a state in which it contacts the edge of the slot 39 in a direction parallel to the direction of a tangent M of the contact portion P during driving of the photosensitive element 10. As a result, the support shaft 34 can be inhibited from vibrating during driving of the photosensitive element 10. In the configuration shown in FIG. 8, the gap G is formed in the bottom of the slot 39 when the support shaft 34 is at the highest position of the slot 39 (when at the position indicated with the broken line in FIG. 8), while the gap G is formed in the top of the slot 39 when the support shaft 34 is at the lowest position of the slot 39 (when at the position indicated with the solid line in FIG. 8). The presence of this gap G enables the support shaft 34 and the bearing 35 to engage with a degree of freedom in the direction of the long axis of the slot 39.

In addition, since the support shaft 34 and the bearing 35 are engaged with a degree of freedom in the direction of the long axis of the slot 39, in the state in which the blade 31 is pressed against the photosensitive element 10, engagement between the support shaft 34 and the bearing 35 in both bearings 35 differs by the amount of the aforementioned tolerance, or in other words, the location of the support shaft 34 relative to the bearing 35 differs (position that differs in the direction of the long axis of the slot 39). In this manner, since the engaging state between the support shaft 34 and the bearing 35 changes enabling the blade 31 to be displaced relative to the photosensitive element 10 even if tolerance occurs as described above, the contact status between the photosensitive element 10 and the blade 31 in the aforementioned lengthwise direction can be maintained.

As was described above, the engaging portion of the blade holder 32 and the frame 33 is such that the support shaft 34 and the bearing 35 are engaged with a degree of freedom due to the presence of the gap G between the support shaft 34 and the bearing 35. However, there is the risk of toner or other foreign objects entering this gap G. If toner or other foreign objects enter the gap G, the degree of freedom between the support shaft 34 and the bearing 35 is restricted, thereby preventing the contact status described above from being maintained.

With respect to such a problem, in the cleaning device 30 of the present embodiment, a foreign object infiltration prevention member for preventing or diminishing entry of foreign objects into the gap G is provided. By providing a foreign object infiltration prevention member that prevents foreign objects from entering the gap G required for realizing engagement having a degree of freedom, the function of the gap G can be properly maintained by preventing it from being soiled with foreign objects. Whereupon, even in a cleaning device 30 in which the free length of the blade 31 is zero resulting in difficulty in the blade 31 making uniform contact with the surface moving member in the form of the photosensitive element 10, the blade 31 is able to contact the photosensitive element 10 without the occurrence of partial contact. Accordingly, cleaning performance is maintained over time.

Figure 9:
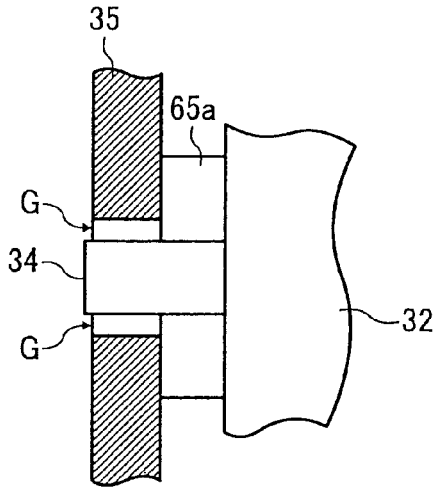
FIG. 9 is a cross-sectional view showing an engaging portion of a bearing and a support shaft of a cleaning device of Example 1 of the present embodiment.

FIG. 9 shows a cross-section of an engaging portion of the bearing 35 and the support shaft 34 in a first example of the cleaning device 30 provided with a foreign object infiltration prevention member (to be referred to as Example 1).

As shown in FIG. 9, the cleaning device 30 of Example 1 arranges a foreign object infiltration prevention member in the form of a foamed member 65*a* for preventing or diminishing entry of foreign objects into the gap G between the support shaft 34 and the bearing 35. The foamed member 65*a* may also be arranged around the support shaft 34 or may be attached to the bearing 35. Although the foreign object infiltration prevention member provided by the cleaning device 30 is the foamed member 65*a* composed of foamed polyurethane for the material thereof, the material is not limited thereto, but rather may be composed of any material provided it does not allow the entry of foreign objects. As shown in FIG. 9, the foamed member 65*a* composed of foamed polyurethane is superior since the support shaft 34 is able to move without being subjected to a load during displacement of the support shaft 34 relative to the bearing 35.

Figure 10A:
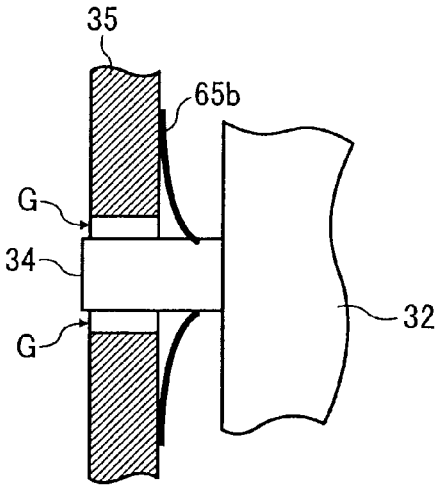
FIG. 10A is a cross-sectional view showing an engaging portion of a bearing and a support shaft of a cleaning device of Example 2 of the present embodiment.
Figure 10B:
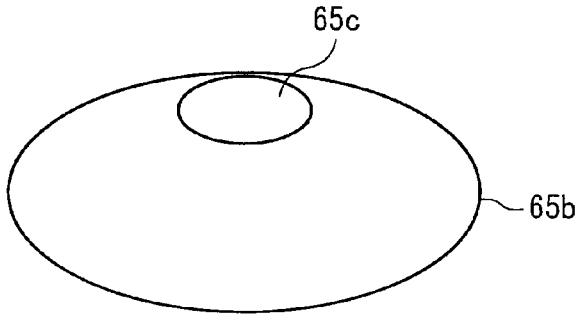
FIG. 10B is a perspective view showing a sheet member of Example 2.

FIGS. 10A and 10B show an engaging portion of the bearing 35 and the support shaft 34 in a second example of the cleaning device 30 provided with a foreign object infiltration prevention member (to be referred to as Example 2), and the foreign object infiltration prevention member of Example 2 in the form of a sheet member 65*b*. FIG. 10A shows a cross-section of an engaging portion of the bearing 35 and the support shaft 34 in the cleaning device 30 of Example 2, while FIG. 10B shows the sheet member 65*b* provided by the cleaning device 30 of Example 2.

As shown in FIGS. 10A and 10B, the sheet member 65*b* is a member composed of an umbrella-shaped sheet in which the central portion thereof protrudes towards the blade holder 32 when attached to the cleaning device 30, and a through hole 65*c*, through which the support shaft 34 passes, is provided in the central portion thereof.

In the cleaning device 30 of Example 2, the function of the gap G (function of maintaining the degree of freedom in the engaging portion of the support shaft 34 and the bearing 35) can be properly maintained without becoming soiled with foreign objects as a result of providing a foreign object infiltration prevention member in the form of the sheet member 65*b*. Since the sheet member 65*b* is thin, it can be installed in a confined space, while also enabling the load to be reduced during movement of the support shaft 34 relative to the bearing 35. In addition, as shown in FIGS. 10A and 10B, the sheet member 65*b* is intentionally warped into the shape of an umbrella, thereby making it difficult for toner and other foreign objects to enter the gap G. Although the sheet member 65*b* is made of polyurethane in the cleaning device 30 of Example 2, it may also be made from other materials.

Although problems caused by entry of foreign objects into the gap G are prevented in Examples 1 and 2 by providing a foreign object infiltration prevention member that makes it difficult for foreign objects to enter the gap G, a configuration may also be employed that inhibits the effects of foreign objects that have entered the gap G. The following provides an explanation of a modification that employs a configuration that inhibits the effects of foreign objects that have entered the gap G in the form of a configuration provided with foreign object storage means in the support shaft 34 or the bearing 35. Furthermore, the cleaning device 30 of this modification employs a configuration that provides foreign object storage means instead of a configuration that provides the foreign object infiltration prevention member of Examples 1 and 2, and since other constituents are the same as those of the cleaning device 30 of the previously described embodiment, an explanation is only provided of the difference between the two, namely the foreign object storage means.

Figure 11:
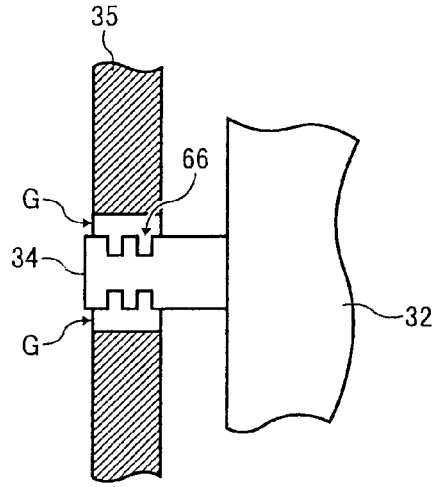
FIG. 11 is a cross-sectional view showing an engaging portion of a bearing and a support shaft in a cleaning device as claimed in a modification of the present embodiment.

FIG. 11 shows a cross-section of an engaging portion of the bearing 35 and the support shaft 34 in cleaning device 30 of a modification.

As was previously described, the degree of freedom between the support shaft 34 and the bearing 35 is limited by the entry of toner or other foreign objects into the gap between the support shaft 34 and the bearing 35. With respect to such problems, the cleaning device 30 of a modification provides foreign object storage means in the form of a foreign object storage groove 66 in the support shaft 34 so that toner and other foreign objects in the gap G do not have an effect on the degree of freedom of the support 34 even if they enter therein.

As shown in FIG. 11, by providing the foreign object storage groove 66 in the support shaft 34, even if toner or other foreign objects have entered the gap between the support shaft 34 and the bearing 35, as a result of the foreign objects collecting in the foreign object storage groove 66, foreign objects that have entered the gap G can be inhibited from limiting the degree of freedom of the support shaft 34.

Figure 12:
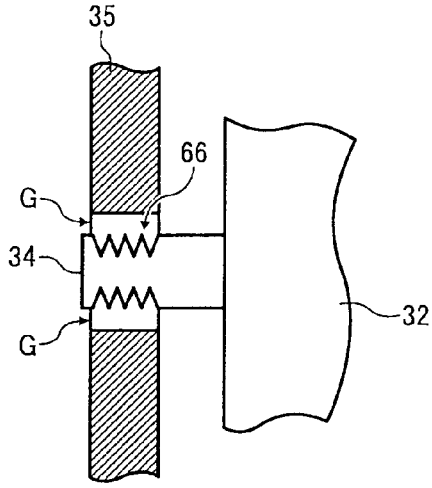
FIG. 12 is a cross-sectional view showing an engaging portion of a first configuration having a different shape for a foreign object storage groove in a cleaning device as claimed in the modification of FIG. 11.
Figure 13:
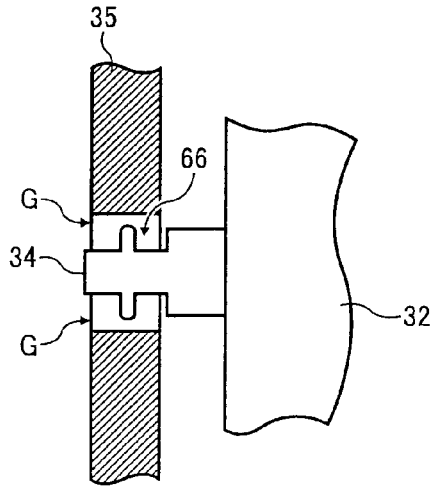
FIG. 13 is a cross-sectional view showing an engaging portion of a second configuration having a different shape for a foreign object storage groove in a cleaning device as claimed in the modification of FIG. 11.

In addition, by employing a form like that shown in FIGS. 12 and 13 for the engaging portion of the support shaft 34 as a configuration provided with a foreign object storage groove 66 in the support shaft 34, susceptibility to the effects of foreign objects may be reduced by decreasing the contact surface areas between the support shaft 34 and the bearing 35. In addition, providing foreign object storage means in the bearing 35 allows the obtaining of similar effects.

Moreover, it goes without saying that incorporating both a configuration provided with foreign object storage means as explained for the modification and a configuration provided with a foreign object infiltration prevention member as explained in Examples 1 and 2 is even more effective.

Furthermore, in the present embodiment, a rigid body having high rigidity is used for the support shaft 34 and the blade holder 32 to increase resistance to the occurrence of twisting and strain in the support shaft 34 and the blade holder 32. This is because the occurrence of twisting or strain in the support shaft 34 and the blade holder 32 prevents positional accuracy between the blade 31 and the photosensitive element 10 from being suitably maintained. Consequently, this can cause the occurrence of partial separation or bellying of the blade, leading to defective cleaning or damage to the photosensitive element 10 of the blade 31. Furthermore, although a stainless steel rod is used for the support shaft 34 in the present embodiment, other metal materials consisting mainly of iron or metal materials consisting mainly of titanium and the like can be used provided they allow the obtaining of high rigidity.

The cleaning device 30 of the present embodiment, as shown in FIG. 4, is provided with urging means in the form of a spring 36 that enhances pressing force in the direction of the normal line N of the contact portion P on the surface of the photosensitive element 10 to which pressing force is applied by the blade 31. In addition, as shown in FIG. 4, a configuration is employed in which the spring 36 applies force to the blade holder 32 through a force application holder 37 fixed to the blade holder 32.

This configuration provides a plurality of the springs 36 in the lengthwise direction of the blade 31 that is the direction extending into and out from in FIG. 4, and in the cleaning device of the present embodiment, two springs 36 are provided in the above-mentioned lengthwise direction. In the case the support shaft 34 and the bearing 35 engage with a degree of freedom in the radial direction as in the present embodiment, the support shaft 34 is in a suspended state without contacting the edge of the bearing at one of the engaging portions of the support shaft 34 and the bearing 35 on both ends in the lengthwise direction, resulting in the support shaft 34 vibrating during driving of the semiconductor element or resulting in a prescribed force being unable to be applied. Consequently, a prescribed pressure can be applied as a result of the springs 36 applying pressing force to the blade 31 in the direction of the above-mentioned normal line through the blade holder 32. Furthermore, occurrence of the risk as described above can be inhibited if a configuration is employed that enables an adequate prescribed pressing force to be applied by the weight of the blade 31, blade holder 32 and the like even if in the state described above.

In the present embodiment, two of the springs 36 are provided, and each of the springs 36 is provided at a location 110 mm away from the center point in the lengthwise direction of the blade 31 (direction of the axis of rotation of the photosensitive element) towards the end thereof in the lengthwise direction. Although the number of pressing springs in the present embodiment is two, the number of springs may be changed.

Figure 14:
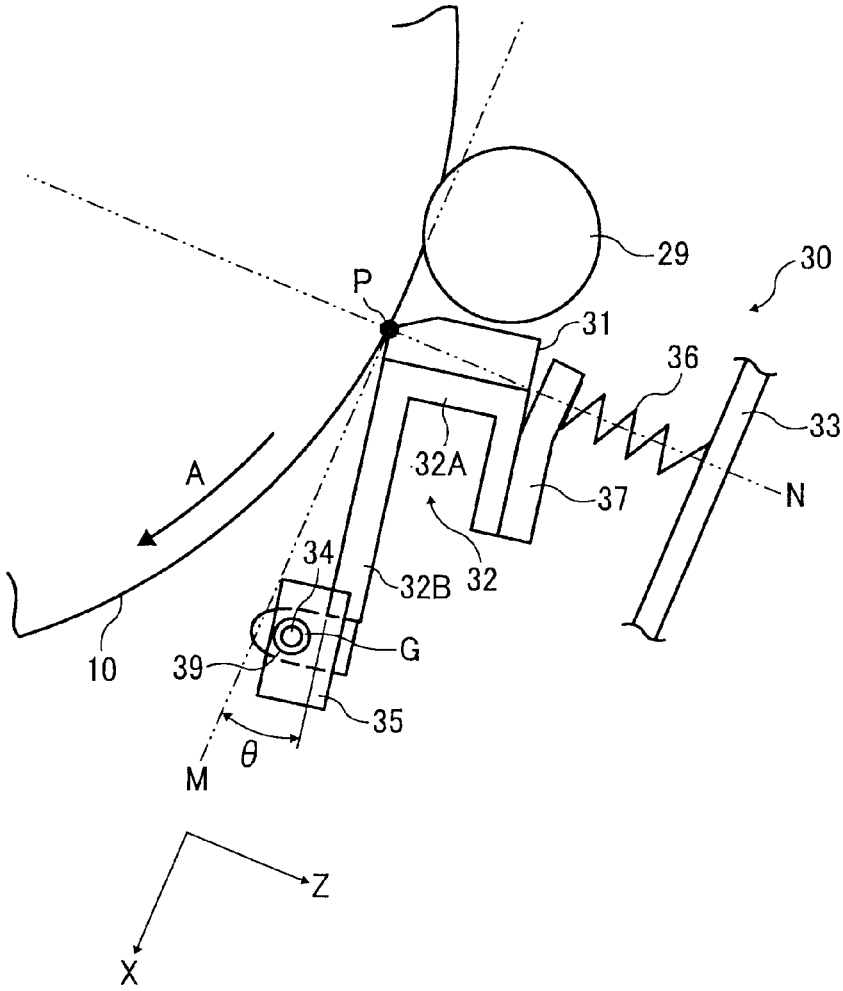
FIG. 14 is a drawing showing a cleaning device in which the angle formed by the contact edge of a blade is an obtuse angle.

In addition, the shape of the blade 31 provided by the cleaning device 30 of the present embodiment is such that the leading edge angle formed by the two surfaces that form the contact edge of the blade that contacts the photosensitive element 10 is an obtuse angle as shown in FIG. 14. More specifically, the angle is preferably 95 to 140°. If the angle is smaller than this, the effects of employing an obtuse shape are diminished, while if the angle is greater than this, the behavior of the plate contact portion becomes unstable. As a result of employing the shape of an obtuse angle, the contact width between the photosensitive element 10 and the blade 31 can be reduced, thereby leading to improved cleaning performance as a result of increasing surface pressure. In addition, as a result of decreasing contact width, the blade contact surface is stabilized and fatigue fracture of the blade is inhibited, thereby leading to reduced blade wear. Furthermore, in the cleaning device 30 of the present embodiment, the leading edge angle formed by the two surfaces that form the contact edge is 120°.

Next, an explanation is provided of measurement of pressing force of the blade 31 on the surface of the photosensitive element 10.

Figure 15:
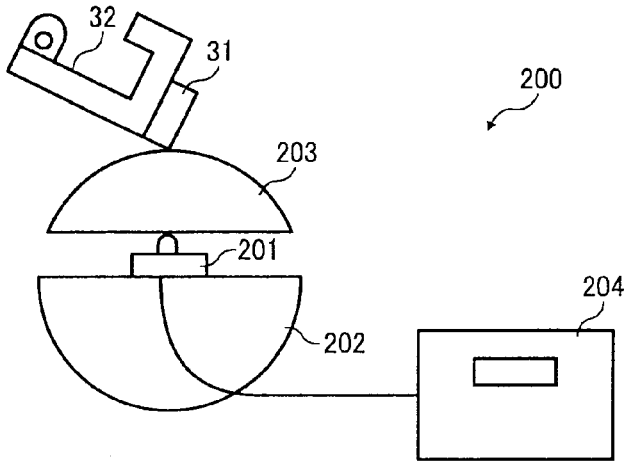
FIG. 15 is a drawing showing the configuration of a device that measures the pressing force of a blade provided in the cleaning device of FIG. 14.

FIG. 15 shows the configuration of a measuring device 200 that measures pressing force of the blade 31. This measuring device 200 actually consists of a commercially available sensor conditioner "WGA-710B (Kyowa Electronic Instruments Co., Ltd.)" and a load cell "LMA-A-20N (Kyowa Electronic Instruments Co., Ltd.)" combined therewith. This measuring device 200 is provided with three load cells 201, and each load cell 201 is respectively fixed at a total of three locations, consisting of the center point in the lengthwise direction of the blade 31 and two points separated by 140 mm from the center point towards both ends in the lengthwise direction, on a semi-cylindrical cell stand 202. In addition, jigs 203 having a curved surface with a radius of curvature equal to that of the photosensitive element 10 are placed on the load cells 201. Three of these jigs 203 are arranged in a row along the lengthwise direction of the blade 31, and each load cell 201 is respectively placed at the center of the bottom surface of each jig 203.

The blade 31 is placed on the measuring device 200 so that the positional relationship of the jigs 203 is the same as the positional relationship with the photosensitive element 10.

In the case of measuring pressing force of the blade 31 on the surface of a photosensitive element 10 using the measuring device 200, the measuring device 200 is attached to a process cartridge 121 instead of a photosensitive element 10 with the cleaning device 30 installed in the printer 100. More specifically, the cell stand 202, on which the three load cells are fixed, and the three jigs 203 are attached to the process cartridge 121 using a support for supporting the drive shaft of the photosensitive element 10. At this time, the measuring device 200 is attached so that a virtual line connecting the contact edge of the blade 31 of the cleaning device 30 and the load cells 201 is perpendicular to the bottom surface of the jigs. A load applied through each jig 203 is detected with the load cells 201, and a value displayed on the sensor conditioner 204 connected to the measuring device 200 is recorded.

Furthermore, during measurement, it goes without saying that it is necessary to place a specified weight on each jig 203 and set so that each of the values displayed on the sensor conditioner 204 are the same, or set so that the values displayed on the sensor conditioner 204 are values for which the load of the jigs 203 has been canceled out, in advance.

In the case of measuring pressing force of the blade 31, although the contact pressure between the blade 31 and the surface of the photosensitive element 10 should inherently be a target value, since it is difficult to measure the contact width (nip width) between the blade 31 and the photosensitive element 10, linear pressure is typically set to be the target value. Here, "linear pressure" refers to the force per unit length in the direction of the axis of rotation of the photosensitive element that acts on the contact portion between the blade 31 and the surface of the photosensitive element 10. A specific method for determining linear pressure consists of dividing the total load obtained by adding the values of each load cell 201 displayed on the sensor conditioner 204 by a length T3 of the blade 31 in the lengthwise direction, and using the resulting value as the value of linear pressure (units: N/cm).

In the present embodiment, the linear pressure was made to be a linear pressure about the same as linear pressure set in a conventional counter method, and more specifically, about 0.790 N/cm. Here, the contact width between the blade 31 and the photosensitive element 10 increases the greater the warping of the blade 31 as previously described, and also increases the greater the deformation of the blade itself. In the cleaning device 30 of the present embodiment, since warping of the blade 31 is restricted by the holder horizontal portion 32A of the blade holder 32 as previously described, there is hardly any warping of the blade 31, and is of a degree that can be ignored when compared with warping of a blade in a cleaning device employing the conventional counter method shown in FIG. 1B. Thus, in the cleaning device 30 of the present embodiment, the contact width mainly depends only on the elastic deformation (compressive deformation) of the blade itself in the direction of movement of the photosensitive element surface. Accordingly, in the cleaning device 30 of the present embodiment, the contact width can be shortened in comparison with a cleaning device employing a conventional counter method as shown in FIG. 1B. As a result, according to the present embodiment, wear of the photosensitive element 10 and the blade 31 can be inhibited in comparison with a conventional cleaning device of the counter type.

In addition, according to the cleaning device 30 of the present embodiment, since the contact width can be shortened as described above, even if the blade 31 is pressed with about the same linear pressure as a conventional cleaning device of the counter type, the contact pressure is higher than that of a conventional cleaning device of the counter type. Conversely, the pressing force of the blade 31 that is required when obtaining contact pressure roughly equal to that of a conventional cleaning device of the counter type can be reduced in comparison with a conventional cleaning device of the counter type. Furthermore, contact width in the present embodiment is predicted to be considerably shorter than contact width in the case of using a conventional cleaning device of the counter type. Thus, on the basis of this prediction, even in the case of linear pressure that is considerably less than the linear pressure in a conventional cleaning device of the counter type, contact pressure can be realized that is roughly equal to that of this cleaning device, and similar removal performance is thought to be able to be demonstrated. With respect to this point as well, the present embodiment is effective for inhibiting wear of the photosensitive element 10 and the blade 31.

In addition, according to the cleaning device 30 of the present embodiment, contact pressure can be increased more easily than a conventional cleaning device of the counter type. Thus, adequate removal performance can be demonstrated even with respect to spherical toner having a small particle diameter that was difficult to be removed with conventional cleaning devices of the counter type.

Multi-function laser printers and laser printers (MFP/LP) using electronic photography systems have recently been required to offer lower costs and higher image quality, and it has become possible to achieve higher image quality (and particularly granularity) by using toner having a smaller particle diameter. However, the use of spherical toner having a small particle diameter makes conventional blade cleaning difficult as explained using FIGS. 1A and 1B, and atypical processing causes increased toner costs. Consequently, it has become imperative to establish a cleaning technology for spherical toner for the purpose of reducing costs and enhancing image quality.

In general, a high contact pressure (surface pressure) is required to clean spherical toner having a small particle diameter with a blade. However, if a configuration is employed in which the cleaning blade and blade holder are adhered with the cleaning blade protruding from the blade holder that holds the cleaning blade by a certain amount as is the case with conventional cleaning blades, the cleaning blade bends when high linear pressure is applied to the cleaning blade, thereby resulting in a considerable increase in the contact width between the cleaning blade and the cleaned member and a decrease in surface pressure that in turn causes a considerable decrease in cleaning performance. Consequently, a configuration is required that enables high surface pressure to be applied.

As an example thereof, the amount of protrusion of the cleaning blade from the blade holder may be made to be nearly zero as in the cleaning device disclosed in Japanese Patent Application Laid-open No. S60-198574. As a result of making the amount of protrusion nearly zero, a large force is applied to the cleaning blade, there is little bending of the cleaning blade, and there is little deformation at the contact portion. Consequently, the contact surface area between the cleaning blade and the cleaned member does not become large and a high surface pressure can be applied, thereby making it possible to maintain cleaning performance.

However, there are also the following potential disadvantages. The degree of freedom of the leading edge of the cleaning blade decreases as a result of making the amount of protrusion of the cleaning blade from the blade holder nearly zero. Consequently, in the case of poor component accuracy or assembly accuracy of the cleaning device or cleaned member, the leading edge of the cleaning blade is unable to deform due to the low degree of freedom, thereby resulting in the disadvantage of it being difficult to make the cleaning blade uniformly contact the cleaned member in the lengthwise direction.

With respect to this problem, a cleaning device is proposed in the previously described prior application that is provided with a plate holder retaining function that absorbs and corrects a shift in the positional relationship as previously described. However, in the case of this function that absorbs and corrects a shift in the positional relationship, there is the risk of corrections being unable to be made due to the entry of toner and other foreign objects into the gap G between the engaging portion and the engaged portion that compose a mechanism that absorbs and corrects shifts.

In response to this problem, the cleaning device 30 of the present embodiment is able to inhibit a function that absorbs and corrects shifts in the positional relationship as described above from not being fulfilled due to that function being soiled by foreign objects by providing the foreign object infiltration prevention member that inhibits entry of foreign objects into the gap G. Consequently, the blade 31 is able to uniformly contact a cleaned member in the form of the photosensitive element 10 in the lengthwise direction, thereby making it possible to secure favorable cleaning performance with respect to spherical toner having a small particle diameter.

Furthermore, urging means such as the spring 36 is not necessarily required to be provided, and the end of the holder horizontal portion 32A of blade holder 32 may be connected to the frame 33 without being mediated by such urging means. In this case, however, the blade holder 32 is no longer able to be displaced relative to the frame 33. Consequently, in the case the positional relationship between the frame 33 and the photosensitive element 10 is fixed, if the distance relationship between the frame 33 and the surface of the photosensitive element 10 changes due to eccentricity and the like of the photosensitive element 10, the blade holder 32 cannot be displaced corresponding to that change. Accordingly, a high degree of manufacturing accuracy is required so that the distance relationship between the frame 33 and the surface of the photosensitive element 10 does not change. In addition, a high degree of assembly accuracy is required by the blade 31 with respect to the photosensitive element 10. In contrast, if urging means is provided as in the present embodiment, even if there is a change in the distance relationship between the frame 33 and the photosensitive element 10 due to eccentricity and the like of the photosensitive element 10, since the blade holder 32 can be displaced corresponding to that change, a high degree of accuracy is not required for the distance relationship between the frame 33 and the photosensitive element 10, nor is a high degree of assembly accuracy required by the blade 31 with respect to the photosensitive element 10.

In the present embodiment, the blade 31 is a member having a rectangular shape that is long in the direction of the axis of rotation (Y direction) of the photosensitive element 10. As shown in FIG. 4, lengths T1 and T2 in directions perpendicular to the contact edge on two adjacent surfaces 31*a* and 31*b* located on both sides of the contact edge (see FIG. 4) are such that the length T1 of the upstream side surface 31*a* located on the upstream side in the direction of surface movement of the photosensitive element is formed to be longer than the length T2 of the downstream side surface 31*b* located on the downstream side in the direction of surface movement of the photosensitive element. Furthermore, the shape of the blade 31 is not limited to this type of cuboid shape, but rather any type of cubic shape can be used provided that the shape of the blade 31 comprises the two adjacent surfaces 31*a* and 31*b* located on both sides of the contact edge, and enables adhered substances on the surface of the photosensitive element 10 to be adequately removed over the direction of the axis of rotation of the photosensitive body. Furthermore, each outer peripheral surface of the blade 31 is not necessarily required to be a flat surface, but rather may also be a curved surface.

Here, the amount of elastic deformation of the blade 31 is less the shorter the blade length towards compressive deformation (length in direction of compression) when the surface of the photosensitive element 10 has moved. The length in the direction of compression of the blade 31 is roughly the length corresponding to the length T2 in the direction of surface movement of the photosensitive element of the downstream side surface 31*b* of the blade 31. When a comparison is made between the length T2 in the present embodiment and the length T2 of a cleaning device employing the conventional counter method shown in FIG. 1B, that in the present embodiment is much shorter than that of the cleaning device employing the conventional counter method. Thus, even when comparing only the amount of elastic deformation, the cleaning device 30 of the present embodiment has less than a cleaning device employing the conventional counter method. On the basis of this as well, the contact width in the cleaning device 30 of the present embodiment can be understood to be shorter than a cleaning device employing a conventional counter method.

Furthermore, in the case of using a cuboid-shaped blade 31 as in the present embodiment, the relationship of the sizes of each length T1, T2 and T3 is preferably composed so as to satisfy the expression T3>T1≧T2. More preferably, T2 is 1 mm or more and ½ or less T1. If T2 is 1 mm or less, there is increased likelihood of generation of abnormal sounds. Furthermore, if a recently popular low-repulsion elastic material is used for the material of the blade 31 or a material having a high JISA hardness is selected, it is predicted that the preferable range will be widened. Furthermore, although the length of each edge of the blade 31 of the present embodiment is such that T1=12 mm, T2=4 mm and T3=325 mm, the dimensions of the blade 31 are naturally not limited thereto.

In addition, the blade 31 of the present embodiment uses that made from polyurethane rubber that has a JISA hardness of about 75°. The material and hardness of the blade 31 are naturally not limited thereto and are suitably selected.

In addition, the blade holder 32 of the present embodiment uses that formed from a metal material consisting mainly of iron, and is provided with adequate rigidity that enables strain to be adequately inhibited even if the blade 31 is subjected to force from the photosensitive element 10 during rotation and driving of the photosensitive element 10.

The present embodiment is composed such that, when in the state in which the blade 31 is not pressed against the surface of the photosensitive element 10, the blade 31 presses against the surface of the photosensitive element 10 at an orientation in which an angle θ formed between the portion of the blade 31 on the upstream side in the direction of surface movement of the photosensitive element at the downstream side surface 31*b*, and the portion on the downstream side in the direction of surface movement of the photosensitive element of the normal line N of the contact portion P on the surface of the photosensitive element 10 (to be referred to as "contact angle θ"), is about 15° (see FIG. 4). Furthermore, the contact angle θ is suitably set within the range of 5 to 50°. It is difficult to set the contact angle θ to an angle of less than 5° in terms of the layout around the photosensitive body, and if the contact angle θ is set to an angle larger than 50°, there is a high possibility of being unable to obtain adequate removal performance. Furthermore, a more preferable range of the contact angle θ is 7 to 40°.

As shown in FIG. 4, the blade 31 in the present embodiment is such that the entire opposing surface of the upstream side surface 31*a* thereof is attached to the holder horizontal portion 32A of the blade holder 32. Although an adhesion method using an adhesive is used for attachment method in the present embodiment, other attachment methods may also be employed, such as a method using double-sided adhesive tape or hot melting. Since the entire opposing surface of the upstream side surface 31*a* of the blade 31 is attached to the holder horizontal portion 32A of the blade holder 32 in this manner, and the blade holder 32 is provided with adequate rigidity as previously described, warping of the blade 31 does not substantially occur in the present embodiment even if the photosensitive element 10 is rotated and driven with the blade 31 pressed against the surface of the photosensitive element 10.

The following effects are obtained as a result of substantial absence of the occurrence of warping of the blade 31 in this manner.

Namely, robustness with respect to environmental fluctuations is improved. More specifically, in a configuration in which blade warping occurs as in the case of the free length portion of the blade being long, force changes in particular due to warping of the blade 31 due to temperature and humidity. For example, if the blade is left in a bent state in a high-temperature, high-humidity environment, it ends up undergoing plastic deformation resulting in occurrence of a phenomenon known as permanent set in fatigue. When this happens, contact pressure of the blade with respect to the surface of the photosensitive element 10 decreases and cleaning performance decreases resulting in the risk of the occurrence of defective cleaning. Thus, in the present embodiment in which there is substantially no occurrence of warping of the blade 31, robustness with respect to environmental fluctuations is improved.

In addition, the occurrence of blade warping means that the blade has a degree of freedom sufficient for the occurrence of warping. If the degree of freedom of the blade is large, there is increased susceptibility to the occurrence of the serious problem of blade buckling when frictional force between the blade and the photosensitive element increases in the case of the counter method. According to the present embodiment in which warping of the blade 31 substantially does not occur, blade buckling is prevented.

Moreover, starting torque of the photosensitive element can be reduced. More specifically, as was previously described, the occurrence of blade warping means that the blade has a degree of freedom sufficient for the occurrence of warping. Since frictional force is large at the start of photosensitive element driving, if the degree of freedom of the blade is large, it is momentarily deformed considerably resulting in an increase in torque. According to the present embodiment in which warping of the blade 31 substantially does not occur, the increase in torque at the start of driving of the photosensitive element 10 can be reduced.

Although the end of the holder horizontal portion 32A on the side in close proximity to the surface of the photosensitive element 10, namely the end of the holder horizontal portion 32A connected to the holder vertical portion 32B, is at the same location as the boundary edge with the downstream side surface 31*b* on the opposing surface (adhesive surface) of the upstream side surface 31*a* of the blade 31 in the present embodiment as shown in FIG. 4, substantial warping of the blade 31 similarly does not occur even if the above-mentioned end of the holder horizontal portion 32A extends to a location close to the surface of the photosensitive element 10 from the above-mentioned boundary edge of the blade 31.

In addition, the above-mentioned end of the holder horizontal portion 32A is not necessarily required to extend to the boundary edge of the blade 31, but rather as long as warping of the blade 31 is substantially restricted, it may only extend to a position that does not reach the boundary edge. Namely, if warping of the blade 31 is substantially restricted, a configuration may be employed in which the end of the holder horizontal portion 32A is farther away from the surface of the photosensitive element than the boundary edge. In this case, the degree to which the end of the holder horizontal portion 32A is farther away from the surface of the photosensitive element than the boundary edge is allowed is determined by the hardness of the blade 31, the coefficient of friction between the blade 31 and the surface of the photosensitive element 10 and the like. In determining that allowable range, the range at which the length in the direction of surface movement of the photosensitive element at the contact portion is 50 μm or less when the blade 31 is pressed against the surface of the photosensitive element 10 such that the surface pressure is, for example, 0.790 N/cm, can be used as a reference. Furthermore, the distance between the end of the holder horizontal portion 32A and the boundary edge is presumed to be allowed to about one-fourth the length T2 of the downstream side surface 31*b* of the blade 31. If further confirmed, this may be allowed from one-half of T2 to about the same length as T2.

In addition, although the blade 31 is adhered to the holder horizontal portion 32A of the blade holder 32 by applying adhesive to the entire adhering surface of the blade 31, the blade 31 may also be adhered to the holder horizontal portion 32A of the blade holder 32 by only applying adhesive to a portion of the adhering surface of the blade 31. However, adhesion processing is preferably carried out at least on the end region of the regions where opposing surfaces of the holder horizontal portion 32A of the blade holder 32 and the upstream side surface 31*a* of the blade 31 are mutually opposed on the side that approaches the surface of the photosensitive element 10. If the holder horizontal portion 32A of the blade holder 32 and the blade 31 are securely adhered in this end region, even if friction between the blade 31 and the surface of the photosensitive element 10 changes due to some factor during rotation and driving of the photosensitive element 10, fluttering of the blade 31 can be stably prevented. This applies similarly to other adhesion methods as well.

Next, an explanation is provided of toner used in the printer of the present embodiment.

According to the cleaning device 30 of the present embodiment, the cleaning device 30 can be used practically in applications that remove toner having an average roundness of 0.940 or more as well as 0.960 to 0.998 since the cleaning device 30 is able to realize high removal performance. Moreover, removal of toner having an average roundness of 0.96 to 0.998 enables the effects of the present invention to be adequately demonstrated.

Toner having an average roundness as described above is obtained by thermal or mechanical spherical processing provided the toner is produced with a dry powder. An example of thermal spherical processing consists of spraying toner particles together with a hot air flow into an atomizer and the like. In addition, an example of mechanical spherical processing consists of loading the toner into a mixer such as a ball mill together with a mixing medium such as glass having a low specific gravity followed by stirring. However, toner particles having a large particle diameter are formed due to aggregation in the case of thermal spherical processing, while fine particles are generated in the case of mechanical spherical processing, thereby requiring an additional size classification step. In addition, in the case of toner produced in an aqueous solvent, shape can be controlled by imparting strong agitation in a step in which the solvent is removed.

Toner roundness refers to a value obtained by detecting particles optically and dividing by the perimeter of an equivalent to the projected area. More specifically, measurement is carried out using a flow-type particle image analyzer (FPIA-2000, Sysmex). 100 to 150 mL of water from which impurity solids have been removed in advance are placed in a prescribed container followed by the addition of 0.1 to 0.5 mL of a dispersant in the form of a surfactant and the addition of about 0.1 to 9.5 g of measurement sample. A suspension in which the sample has been dispersed is subjected to dispersion treatment for about 1 to 3 minutes with an ultrasonic disperser, followed by measuring toner shape and distribution using a dispersed concentration of 3000 to 10000 particles/μL. Roundness is defined as SR=(perimeter of circle having a surface area equal to the projected particle surface area/perimeter of projected particle image), and this value approaches 1 the close the toner particle is to being a perfect sphere.

Toner having a high degree of roundness is easily affected by electric flux lines on the surface of the carrier or the developing roller 51, and images are faithfully developed along electric flux lines of an electrostatic latent image. Thus, narrow line reproducibility becomes higher since a fine, uniform toner arrangement is easily adopted during reproduction of fine latent image dots.

In addition, toner having a high degree of roundness is easily affected by electric flux lines due to having a smooth surface and suitable fluidity, and transfer rate becomes higher since the toner is able to faithfully move along the electric flux lines, thereby allowing the obtaining of high-quality images. Moreover, together with a primary transfer nip being formed by pressing the intermediate transfer belt 162 with the primary transfer rollers 161, a transfer electric field is formed by applying a transfer voltage of a polarity opposite that of the toner image to the primary transfer rollers 161, and as a result of these actions, during primary transfer of each toner image on the photosensitive element 10 onto the intermediate transfer belt 162 as well, the toner having a high degree of roundness uniformly contacts the intermediate transfer belt 162 and the contact surface area of the toner becomes even, thereby contributing to improvement of the transfer rate.

However, if the average roundness of the toner is less than 0.93, faithful image transfer at a high transfer rate is no longer possible. This is because due to the irregular shape of the toner, charging of the toner surface is uneven and there is a shift between the center of gravity and the center of the charge, thereby making it difficult for the toner to move faithfully relative to the electric field.

In addition, since a smaller volume average particle diameter makes it possible to improve fine line reproducibility, toner having volume average particle diameter of no larger than 7 μm is used preferably. However, since image properties decrease as particle diameter becomes smaller, the toner preferable has a volume average particle diameter of at least 3 μm. Moreover, if the toner volume average particle diameter is less than 3 μm, since a large amount of toner having a minute particle diameter that is difficult to develop is present on the surface of the carrier or the developing roller 51, contact/friction of other toner with the carrier or developing roller becomes inadequate, a large amount of opposite-charged toner is present, and abnormal image exhibiting fogging and the like are formed, thereby making this undesirable.

In the cleaning device 30 of the present embodiment, toner having a volume average particle diameter of 2 μm or more makes it possible to demonstrate adequate removal performance, while toner having a volume average particle diameter of 3 μm or more in particular makes it possible to demonstrate more preferable removal performance. Furthermore, the ratio of volume average particle diameter Dv to number average particle diameter Dn is preferably about 1.0 to 1.4.

Volume average particle diameter of toner is measured in the manner described below.

First, 0.1 to 5 mL of a dispersant in the form of a surfactant (preferably an alkylbenzene sulfonate) is added to 100 to 150 mL of an electrolytic aqueous solution. Here, an electrolyte refers to the preparation of an approximately 1% aqueous NaCl solution using grade 1 sodium chloride, and ISOTON Type R-II (Coulter Scientific Japan) was used here. 2 to 20 mg of measurement sample are then added thereto to suspend in the electrolyte followed by subjecting to dispersion treatment for about 1 to 3 minutes with an ultrasonic disperser. The volume distribution and quantity distribution of the toner are then calculated by measuring with the measurement device described above using a 100 μm aperture for the aperture and measuring the distribution and quantity of toner particles in the sample for each channel.

A total of 13 channels were used for the channels, consisting of 2.00 to 2.52 μm, 2.52 to 3.17 μm, 3.17 to 4.00 μm, 4.00 to 5.04 μm, 5.04 to 6.35 μm, 6.35 to 8.00 μm, 8.00 to 10.08 μm, 10.08 to 12.70 μm, 12.70 to 16.00 μm, 16.00 to 20.20 μm, 20.20 to 25.40 μm, 25.40 to 32.00 μm and 32.00 to 40.30 μm.

In addition, toner that satisfies the average roundness described above while also having a shape factor SF-1 within the range of 100 to 160 and a shape factor SF-2 within the range of 100 to 160 is preferable.

Figure 16A:
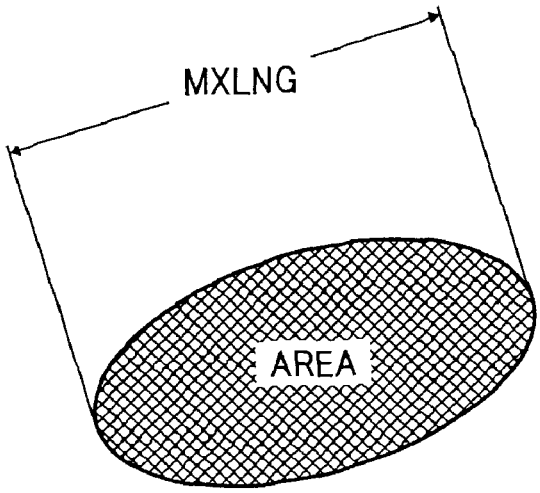
FIGS. 16A and 16B are drawings schematically showing the shapes of toner.
Figure 16B:
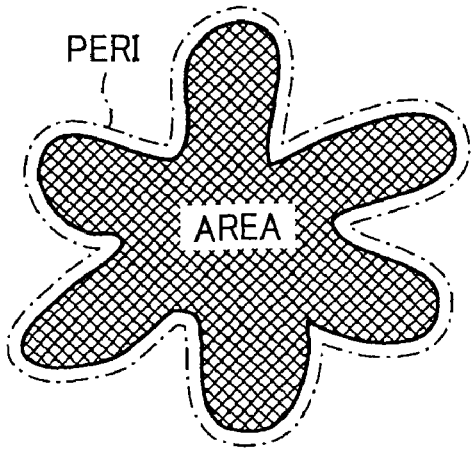

FIGS. 16A and 16B schematically show toner shapes. FIG. 16A is a drawing for explaining shape factor SF-1, while FIG. 16B is a drawing for explaining shape factor SF-2.

Shape factor SF-1 indicates the proportion of roundness of toner shape, and is represented by the following formula (1). This value is obtained by dividing the square of a maximum length MXLNG of a shape obtained by projecting the toner in a two-dimensional plane by a shape surface area AREA followed by multiplying by 100π/4. The shape of toner in the case the value of SF-1 is 100 is a perfect sphere, and the shape becomes increasingly irregular the greater the value of SF-1.

$$SF\text{-}1=\{(MXLNG)^2/AREA\}\times(100\pi/4) \quad (1)$$

In addition, shape factor SF-2 indicates the proportion of surface irregularities in toner shape, and is represented by the following formula (2). This value is obtained by dividing the square of a perimeter PERI of a shape obtained by projecting the toner in a two-dimensional plane by a shape surface area AREA followed by multiplying by 100π/4. There are no surface irregularities present in toner surface in the case the value of SF-2 is 100, and surface irregularities in the toner surface become increasingly prominent the greater the value of SF-2.

$$SF\text{-}2=\{(PERI)^2/AREA\}\times(100\pi/4) \quad (2)$$

More specifically, measurement of shape factors was carried out by taking a photograph of the toner with a scanning electron microscope (S-800, Hitachi), and then introducing this into an image analyzer (LUSEX3, Nireco) followed by analysis and calculation of shape factors.

As the shape of the toner becomes rounder, adhesive strength between toner particles becomes weaker due to contact between toner particles being in the form of point contact, and as a result, fluidity increases, adsorption force between the toner and the photosensitive element 10 becomes weaker and transfer rate increases, thereby facilitating cleaning of residual toner from the surface of the photosensitive element 10. If SF-1 and SF-2 become larger, shape becomes irregular, charge distribution of the toner becomes broader, and images become less faithful to the latent image while also becoming less faithful to the transfer electric field during transfer as well, thereby resulting in a decrease in image quality. Consequently, both SF-1 and SF-2 preferably do not exceed 180.

Preferable examples of such roughly spherical toners include toners obtained by subjecting a toner composition, which contains a polyester prepolymer having a functional group containing a nitrogen atom, a polyester, a colorant and a mold release agent, to a crosslinking and/or elongation reaction in the presence of resin fine particles in an aqueous solvent. In the case of conventional processes used to produce powdered toner, either toner cannot be produced based on a comparison of roundness, average particle diameter and shape factors SF-1 and SF-2, or toner obtained by a polymerization method is superior in terms of production cost and yield.

However, even in the case of toner obtained with a polymerization method, the shape of toner obtained with a suspension polymerization method or emulsification polymerization method has difficulty in obtaining perfectly spherical toner in terms of roundness and shape factors SF-1 and SF-2. In particular, although toner obtained by an SPSS (suspension of polymer solution solvent) method is spherical, a satisfactory level of quality is unable to be obtained with respect to image quality and the like since it is an irregularly shaped toner.

Next, a detailed description is provided of constituent materials of a toner obtained by subjecting a toner composition, which contains a polyester prepolymer having a functional group containing a nitrogen atom, a polyester, a colorant and a mold release agent, to a crosslinking and/or elongation reaction in the presence of fine resin particles in an aqueous solvent, and a preferable production process thereof.

(Polyester)

The polyester is obtained by a polycondensation reaction between a polyvalent alcohol compound and a polyvalent carboxylic acid compound.

Examples of polyvalent alcohol compounds (PO) include divalent alcohols (DIO) and trivalent or greater polyvalent alcohols (TO), with a DIO alone or a mixture of a DIO and a small amount of a TO being preferable.

A preferable divalent alcohol (DIO) is an alkylene oxide adduct of an alkylene glycol having 2 to 12 carbon atoms and a bisphenol, and an alkylene oxide adduct of a bisphenol and the combined use of this with an alkylene glycol having 2 to 12 carbon atoms are particularly preferable.

Examples of trivalent or more polyvalent alcohols (TO) include trivalent to octavalent or more polyvalent aliphatic alcohols (such as glycerin, trimethylolethane, trimethylolpropane, pentaerythritol or sorbitol), trivalent or more phenols (such as trisphenol PA, phenol novolak or cresol novolak), and alkylene oxide adducts of trivalent or more polyphenols.

Examples of polyvalent carboxylic acids (PC) include divalent carboxylic acids (DIC) and trivalent or more polyvalent carboxylic acids (TC), with a DIC alone or a mixture of a DIC and a small amount of TC being preferable. Examples of the divalent carboxylic acid (DIC) consist of alkenylene dicarboxylic acids having 4 to 20 carbon atoms and aromatic dicarboxylic acids having 8 to 20 carbon atoms. Examples of trivalent or more polycarboxylic acids (TC) include aromatic polyvalent carboxylic acids having 9 to 20 carbon atoms (such as trimellitic acid or pyromellitic acid).

The ratio of polyvalent alcohol (PO) to polyvalent carboxylic acid (PC) in terms of the equivalent ratio of hydroxyl groups (OH) to carboxylic acid groups (COOH) (OH/COOH) is normally 2/1 to 1/1, preferably 1.5/1 to 1/1, and more preferably 1.3/1 to 1.02/1.

The polycondensation reaction between the polyvalent alcohol (PO) and the polyvalent carboxylic acid (PC) is carried out by heating to 150 to 280° C. in the presence of a known esterification catalyst such as tetrabutoxy titanate or dibutyltin oxide and distilling off the water formed while reducing pressure as necessary to obtain a polyester having hydroxyl groups.

In addition to the undenatured polyester obtained in the polycondensation reaction described above, urea-denatured polyester is also preferably included in the polyester. Urea-denatured polyester causes a reaction between carboxyl groups or hydroxyl groups on the ends of the polyester obtained in the polycondensation reaction and polyvalent isocyanate compounds (PIC), resulting in the obtaining of a polyester prepolymer (A) having an isocyanate group, and allowing the obtaining of a molecule chain by crosslinking and/or elongation as a result of reacting with an amine.

Examples of polyvalent isocyanates (PIC) include aliphatic polyvalent isocyanates, alicyclic polyisocyanates, aromatic diisocyanates, aromatic-aliphatic diisocyanates, and isocyanates and the above-mentioned polyisocyanates blocked with a phenol derivative, oxime or caprolactam and the like, and mixtures of two or more types thereof.

The ratio of the polyvalent isocyanate compound (PIC) in terms of the equivalent ratio (NCO/OH) of isocyanate groups (NCO) to hydroxyl groups (OH) of the polyester having hydroxyl groups is normally 5/1 to 1/1, preferably 4/1 to 1.2/1 and more preferably 2.5/1 to 1.5/1.

The content of polyvalent isocyanate compound (PIC) constituents in the polyester prepolymer (A) having isocyanate groups is normally 0.5 to 40% by weight, preferably 1 to 30% by weight, and more preferably 2 to 20% by weight.

The number of isocyanate groups contained per molecule in the polyester prepolymer (A) having isocyanate groups is normally 1 or more, preferably an average of 1.5 to 3, and more preferably an average of 1.8 to 2.5.

Next, examples of an amine (B) that reacts with the polyester prepolymer (A) include divalent amine compounds (B1), trivalent or more polyvalent amine compounds (B2), amino alcohols (B3), amino mercaptans (B4), amino acids (B5), and amines in which amino groups of B1 to B5 are blocked (B6).

Examples of the divalent amino compounds (B1) include aromatic diamines, alicyclic diamines, and aliphatic diamines. Examples of the trivalent or more polyvalent amine compounds (B2) include diethylenetriamine and triethylenetetraaamine. Examples of the amino alcohols (B3) include ethanolamine and hydroxyethylaniline. Examples of the amino mercaptans (B4) include aminoethylmercaptan and aminopropylmercaptan. Preferable examples of these amines (B) consist of B1 and mixtures of B1 and a small amount of B2.

The ratio of the amine (B) in terms of the equivalent ratio (NCO/NHx) of isocyanate groups (NCO) in the polyester prepolymer (A) having isocyanate groups to amino groups (NHx) in the amine (B) is normally 1/2 to 2/1, preferably 1.5/1 to 1/1.5 and more preferably 1.2/1 to 1/1.2.

Urea-denatured polyesters are produced by a one-shot method, for example. A polyvalent alcohol (PO) and a polyvalent carboxylic acid (PC) are heated to 150 to 280° C. in the presence of an esterification catalyst such as tetrabutoxy titanate or dibutyltin oxide followed by distilling off the water formed while reducing pressure as necessary to obtain a polyester having hydroxyl groups.

Next, this is reacted with polyvalent isocyanate (PIC) at 40 to 140° C. to obtain the polyester prepolymer (A) having isocyanate groups. Moreover, the amine (B) is reacted with this (A) at 0 to 140° C. to obtain an urea-denatured polyester.

A solvent can be used as necessary during the reaction of the (PIC) and the reaction between (A) and (B). Examples of solvents that can be used include those that are inert with respect to the isocyanate (PIC), such as aromatic solvents, ketones or esters.

In addition, a reaction terminator can be used as necessary in the crosslinking and/or elongation reaction between the polyester prepolymer (A) and the amine (B) to adjust the molecular weight of the resulting urea-denatured polyester. Examples of reaction terminators include monoamines (such as diethylamine, dibutylamine, butylamine or laurylamine), and ketimine compounds formed by the blocking thereof.

The weight average molecular weight of the urea-denatured polyester is normally 10,000 or more, preferably 20,000 to 10,000,000 and more preferably 30,000 to 1,000,000. There are no particular limitations on the number average molecular weight of the urea-denatured polyester in the case of using an undenatured polyester as previously described, and is a number average molecular weight that facilitates obtaining of the weight average molecular weights described above. In the case of using the urea-denatured polyester alone, the number average molecular weight thereof is normally 2,000 to 15,000, preferably 2,000 to 10,000 and more preferably 2,000 to 8,000.

The weight ratio of the undenatured polyester to the urea-denatured polyester is normally 20/80 to 95/5, preferably 70/30 to 95/5, more preferably 75/25 to 95/5, and particularly preferably 80/20 to 93/7. The glass transition temperature (Tg) of the binder resin containing the undenatured polyester and the urea-denatured polyester is normally 45 to 65° C. and preferably 45 to 60° C.

(Colorant)

All known dyes and pigments can be used for the colorant, examples of which include carbon black, nigrosine dyes, naphthol yellow S, cadmium yellow, yellow iron oxide, chrome yellow, minium, vermillion, cadmium red, lithol fast scarlet G, benzidine orange, oil orange, cobalt blue, cerulean blue, alkali blue lake, fast sky blue, indigo, ultramarine, Prussian blue, manganese violet, dioxane violet, chrome green, viridian, emerald green, pigment green B, phthalocyanine green and mixtures thereof. The content of the colorant is normally 1 to 15% by weight and preferably 3 to 10% by weight based on the toner.

The colorant can be used in the form of a master batch compounded with resin. Polymers of styrenes such as polystyrene, poly-p-chlorostyrene or polyvinyl toluene and substituted forms thereof, or copolymer of these and vinyl compounds, polymethyl methacrylate, polyvinyl acetate, polyethylene, polypropylene, polyester, epoxy resins, chlorinated paraffin or paraffin wax and the like can be used alone or in the form of a mixture for production of the master batch or as binder resins mixed with the master batch.

(Charge Control Agent)

A known agent can be used as a charge control agent, examples of which include nigrosine-based dyes, triphenylmethane-based dyes, chrome-containing metal complex dyes, phosphorous or phosphorous compounds, tungsten or tungsten compounds, fluorine-based activators, salicylic acid metal salts and metal salts of salicylic acid derivatives. Specific examples include the nigrosine-based dye Bontron 03, the salicylic acid-based metal complex E-84 and the phenol-based condensate E-89 (all of which are manufactured by Orient Chemical Industries Co., Ltd.), the quaternary ammonium salt molybdenum complexes TP-302 and TP-415 (manufactured by Hodogaya Chemical Co., Ltd.), the quaternary ammonium salt Copy Charge PSY VP2038, the triphenylmethane derivatives Copy Blue PR and LRA-901 and the borone complex LR-147 (manufactured by Japan Carlit Co., Ltd.), copper phthalocyanine, perylene, quinacridone, azo-based pigments and other polymer-based compounds having a functional group such as a sulfonic acid group, carboxyl group or quaternary ammonium salt. In particular, substances that control the toner to have negative polarity are used preferably.

Although there are no universal limitations on the amount of the charge control agent used since the amount thereof is determined according to the type of binder resin, the presence or absence of additives used as necessary, and the toner production process, including the dispersion method, it is preferably used within the range of 0.1 to 10 parts by weight and more preferably within the range of 0.2 to 5 parts by weight based on 100 parts by weight of the binder resin.

(Mold Release Agent)

A low-temperature melting wax having a melting point of 50 to 120° C. acts more effectively as a mold release agent during dispersion with the binder resin. Examples of waxes used as such wax components include vegetable waxes such as carnauba wax or cotton wax, animal waxes such as beeswax or lanolin, mineral waxes such as ozokerite or cercine, and petroleum waxes such as paraffin, microcrystalline wax or petrolatum.

In addition to these natural waxes, examples of synthetic waxes include synthetic hydrocarbon waxes such as Fischer-Tropsch wax or polyethylene wax, and synthetic waxes of esters, ketones, ethers and the like.

(External Additives)

Inorganic fine particles are preferably used as an external additive for assisting the fluidity, developability and chargeability of toner particles. The primary particle diameter of these inorganic fine particles is preferably $5\times10^{-3}$ to 2 μm and particularly preferably $5\times10^{-3}$ to 0.5 μm.

In addition, the specific surface area as determined with the BET method is preferably 20 to 500 $m^2/g$. The proportion of these inorganic fine particles used is preferably 0.01 to 5% by weight and particularly preferably 0.01 to 2.0% by weight of the toner.

Specific examples of inorganic fine particles include those of silica, alumina, titanium oxide, barium titanate, zinc oxide, calcium carbonate, silicon carbide and silicon nitride. The combined use of hydrophobic silica fine particles and hydrophobic titanium oxide fine particles is particularly preferable for use as an agent for imparting fluidity.

(Toner Production Method)

The following provides a detailed description of a toner production process. Although a preferable method is indicated here, the method used is not limited thereto.

A colorant, undenatured polyester, polyester prepolymer having an isocyanate group, and mold release agent are dispersed in an organic solvent to produce a toner material liquid. The organic solvent is preferably a volatile solvent having a boiling point lower than 100° C. since this facilitates removal following formation of toner matrix particles. More specifically, an aromatic solvent such as toluene or xylene and a halogenated hydrocarbon such as methylene chloride, 1,2-dichloroethane, chloroform or carbon tetrachloride can be used alone or in a combination of two or more types thereof. The amount of organic solvent used is normally 0 to 300 parts by weight, preferably 0 to 100 parts by weight and more preferably 25 to 70 parts by weight based on 100 parts by weight of the polyester prepolymer.

The toner material liquid is emulsified in an aqueous medium in the presence of a surfactant and resin fine particles. Water may be used alone for the aqueous medium or the aqueous medium may contain an alcohol such as methanol or an organic solvent such as dimethylformamide, tetrahydrofuran, Cellusolve or lower ketone. The amount of aqueous medium used to 100 parts by weight of the toner material liquid is normally 50 to 2000 parts by weight and preferably 100 to 1000 parts by weight. If the amount used is less than 50 parts by weight, the dispersed state of the toner material liquid becomes poor, and toner particles of a prescribed particle diameter are unable to be obtained. The process becomes uneconomical if the amount used exceeds 2000 parts by weight.

In addition, a dispersant such as a surfactant or resin fine particles is added to improve dispersion in the aqueous medium. Examples of surfactants include anionic surfactants such as alkylbenzene sulfonic acid salts, and cationic surfactants such as alkylamine salts, aminoalcohol fatty acid derivatives, polyamine fatty acid derivatives or quaternary ammonium salts such as alkyltrimethylammonium salts. In addition, the use of a surfactant having a fluoroalkyl group makes it possible to demonstrate the effects thereof using an extremely small amount.

A previously described substance can be used for the resin fine particles. In addition, an inorganic compound dispersant such as tricalcium phosphate, calcium carbonate, titanium oxide, colloidal silica or hydroxyapatite can also be used. Dispersed liquid droplets may also be stabilized with a polymer-based protective colloid for use as a dispersion enabling the combined use of resin fine particles and an inorganic compound dispersant. For example, acids such as acrylic acid, methacrylic acid, α-cyanoacrylic acid, α-cyanomethacrylic acid, itaconic acid, crotic acid, fumaric acid, maleic acid or maleic anhydride, or (meth)acrylic monomers containing a hydroxyl group, such as β-hydroxyethyl acrylate, β-hydroxyethyl methacrylate, β-hydroxypropyl acrylate, β-hydroxypropyl methacrylate or γ-hydroxypropyl acrylate, can be used.

Although there are no particular limitations on the dispersion method, known equipment can be applied, such as low-speed shearing equipment, high-speed shearing equipment, frictional equipment, high-pressure jet equipment and ultrasonic equipment. Among these, high-speed shearing is preferable for obtaining a dispersion having a particle diameter of 2 to 20 μm. In the case of using a high-speed shearing type of disperser, although there are no particular limitations on the rotating speed thereof, the rotating speed is normally 1000 to 30000 rpm and preferably 5000 to 20000 rpm. Although there are no particular limitations on the dispersion time, in the case of a batch method, the dispersion time is normally 0.1 to 5 minutes. The temperature during dispersion is normally 0 to 150° C. (under pressure) and preferably 40 to 98° C.

The amine (B) is added simultaneous to production of the emulsion to carry out a reaction with the polyester prepolymer (A) having an isocyanate group. This reaction is accompanied by crosslinking and/or elongation of the molecule chain. Although the reaction time is selected according to the reactivity between the isocyanate group structure of the polyester prepolymer (A) and the amine (B), it is normally 10 minutes to 40 hours an preferably 2 to 24 hours. The reaction temperature is normally 0 to 150° C. and preferably 40 to 98° C. In addition, a known solvent can be used as necessary, specific examples of which include dibutyltin laurate and dioctyltin laurate.

Following completion of the reaction, the organic solvent is removed from the emulsified dispersion (reaction product), followed by washing and drying to obtain toner matrix particles. Roughly spherical toner matrix particles can be produced by gradually heating the entire system in a state of agitated laminar flow and imparting strong agitation at a constant temperature followed by desolvation in order to remove the organic solvent. Here, the shape of the particles can be controlled from, for example, a perfect spherical shape to a fusiform shape. Moreover, the particles can be controlled from those having a smooth surface morphology to those having a wrinkled surface. In addition, in the case of using a substance soluble in acid or alkali such as calcium phosphate salt as a dispersion stabilizer, the calcium phosphate salt is removed from the toner matrix particles by dissolving the calcium phosphate salt with an acid such as hydrochloric acid and then rinsing with water. In addition, the calcium phosphate salt can also be removed by a procedure such as decomposing with an enzyme.

A step for allowing the formed toner particles to age by allowing the emulsified dispersion to stand for a fixed amount of time at a fixed temperature can be provided either before or after the above-mentioned washing and desolvation steps. As a result, toner particles can be produced having a desired particle diameter. The temperature of the aging step is preferably 25 to 50° C., and the aging time is preferably 10 minutes to 23 hours.

The toner matrix particles obtained in the manner described above are injected with a charge control agent followed by the addition of inorganic fine particles such as silica fine particles or titanium oxide fine particles to obtain toner.

Injection of the charge control agent and addition of the inorganic fine particles is carried out with a known method using a mixer and the like.

As a result, toner having a small particle diameter and sharp particle diameter distribution can be obtained.

Although the toner of the present embodiment is used a two-component developer by mixing with a magnetic carrier, it can also be used as a one-component magnetic toner or non-magnetic toner without using a carrier.

A conventionally known magnetic carrier having a particle diameter of 20 to 200 μm, such as iron powder, ferrite powder, magnetite powder or a magnetic resin carrier, can be used as the magnetic carrier of a two-component developer. In addition, examples of coating materials include amino-based resins such as urea-formaldehyde resin, melamine resin, benzoguanamine resin, urea resin, polyamide resin or epoxy resin. In addition, polyvinyl resins or polyvinylidene resins such as acrylic resin, polymethyl methacrylate resin, polyacrylonitrile resin, polyvinyl acetate resin, polyvinyl alcohol resin, polyvinyl butyral resin, polycarbonate resin, polyethylene resin or silicone resin can be used. In addition, an electrically conductive powder and the like may also be contained in the coating resin as necessary. Examples of electrically conductive powders that can be used include metal powder, carbon black, titanium oxide, tin oxide and zinc oxide.

These electrically conductive powders preferably have an average particle diameter of 1 μm or less. If the average particle diameter exceeds 1 μm, control of electrical resistance becomes difficult.

In the present embodiment, spherical ferrite particles having an average particle diameter of 50 μm are employed as a core material, an aminosilane-based coupling agent and silicone resin were dispersed in toluene for the coating material constituent material, and this dispersion and the core material were placed in a coating device, which is provided with a rotary bottom plate disc and stirring blade in a fluidized bed and which carries out coating while forming a swirling flow, to coat the dispersion onto the core material. The resulting coated product was baked for 2 hours in an electric furnace at 250° C. to produce carrier particles coated with silicone resin at an average thickness of 0.5 μm. 7 parts by weight of toner indicated in the following examples were uniformly mixed with 100 parts by weight of this carrier using a tumbler mixer of a type in which a container is rotated to affect stirring to obtain an initial developer.

The following provides an explanation of examples of toner.

Furthermore, although the toners of each of the examples is produced in the manner described below, the present invention is not limited thereto. Furthermore, the term "parts" indicates parts by weight.

[Toner 1]

(Synthesis of Resin Fine Particle Emulsion)

683 parts of water, 11 parts of a sodium salt of a phosphate ester of a sodium salt of methacrylic acid ethylene oxide adduct sulfate ester (Ereminol RS-30, Sanyo Chemical Industry Co., Ltd.), 83 parts of styrene, 83 parts of methacrylic acid, 110 parts of butyl acrylate and 1 part of ammonium persulfate were charged into a reaction vessel equipped with a stirring rod and a thermometer followed by stirring for 30 minutes at 3800 rpm/min to obtain a white emulsion. The emulsion was then heated to an internal temperature of 75° C. and allowed to react for 4 hours. Moreover, 30 parts by weight of 1% aqueous ammonium persulfate solution were added followed by aging for 6 hours at 75° C. to obtain an aqueous Fine Particle Dispersion 1 of a vinyl resin (copolymer of styrene, methacrylic acid, butyl acrylate and sodium salt of methacrylic acid ethylene oxide adduct sulfate ester). Volume average particle diameter as determined by measuring the Fine Particle Dispersion 1 with a laser diffraction/scattering type particle size distribution analyzer (LA-920, Horiba, Ltd.) was 110 nm. A portion of the Fine Particle Dispersion 1 was dried followed by isolation of the resin portion. The shape of the resin fine particles was spherical. The Tg of the resin portion was 58° C. and the weight average molecular weight was 130,000.

(Preparation of Aqueous Phase)

990 parts of water, 83 parts of the Fine Particle Dispersion 1, 37 parts of a 48.3% aqueous solution of sodium dodecyl diphenyl ether disulfonate (Ereminol MON-7, Sanyo Chemical Industry Co., Ltd.) and 90 parts of ethyl acetate were mixed and stirred to obtain a milky white liquid. This was designated as Aqueous Phase 1.

(Synthesis of Low Molecular Weight Polyester)

724 parts by weight of a bisphenol A ethylene oxide bimolar adduct and 276 parts of terephthalic acid were placed in a reaction vessel equipped with a cooling tube, stirrer and nitrogen feed tube, followed by carrying out polycondensation for 7 hours at normal pressure and 230° C. and further reacting for 5 hours under reduced pressure of 10 to 15 mmHg to obtain a Low Molecular Weight Polyester 1. The Low Molecular Weight Polyester 1 had a number average molecular weight of 2300, weight average molecular weight of 6700, peak molecular weight of 3800, Tg of 43° C. and an acid value of 4.

(Synthesis of Intermediate Polyester)

682 parts of a bisphenol A ethylene oxide bimolar adduct, 81 parts of a bisphenol A propylene oxide bimolar adduct, 283 parts of terephthalic acid, 22 parts of trimellitic anhydride and 2 parts of dibutyltin oxide were placed in a reaction vessel equipped with a cooling tube, stirrer and nitrogen feed tube followed by reacting for 7 hours at normal pressure and 230° C. and further reacting for 5 hours under reduced pressure of 10 to 15 mmHg to obtain an Intermediate Polyester 1. The Intermediate Polyester 1 had a number average molecular weight of 2200, weight average molecular weight of 9700, peak molecular weight of 3000, Tg of 54° C., acid value of 0.5 and hydroxyl value of 52. Next, 410 parts of the Intermediate Polyester 1, 89 parts of isophorone diisocyanate and 500 parts of ethyl acetate were placed in a reaction vessel equipped with a cooling tube, stirrer and nitrogen feed tube followed by reacting for 5 hours at 100° C. to obtain a Prepolymer 1. The weight percentage of free isocyanate in the Prepolymer 1 was 1.53%.

(Synthesis of Ketimine)

170 parts of isophorone diamine and 75 parts of methyl ethyl ketone were charged into a reaction vessel equipped with a stirrer and a thermometer following by reacting for 4.5 hours at 50° C. to obtain a Ketimine Compound 1. The amine value of the Ketimine Compound 1 was 417.

(Synthesis of Master Batch)

1200 parts of water, 540 parts of carbon black (Printex35, Degussa GmbH, DBP oil absorption=42 ml/100 mg, pH=9.5) and 1200 parts of polyester resin were added and mixed with a Henschel mixer (Mitsui Mining Co., Ltd.), and the mixture was kneaded for 1 hour at 130° C. using a two-roll mixing mill followed by rolling and cooling and then crushing with a pulverizer to obtain a Master Batch 1.

(Production of Oily Phase)

378 parts of the Low Molecular Weight Polyester 1, 100 parts of carnauba wax and 947 parts of ethyl acetate were charged into a reaction vessel equipped with a stirrer and a thermometer followed by heating to 80° C. while stirring, holding at 80° C. for 5 hours, and then cooling to 30° C. in 1 hour.

Next, 500 parts of the Master Batch 1 and 500 parts of ethyl acetate were charge into a reaction vessel followed by mixing for 1 hour to obtain a Raw Material Solution 1. 1324 parts of the Raw Material Solution 1 were transferred to a reaction vessel followed by dispersing carbon black and wax therein under conditions of three passes using a bead mill (Ultra Visco Mill, Imex Co., Ltd.) at a liquid feed rate of 1 kg/hr and disc peripheral velocity of 6 m/sec after filling with 0.5 mm zirconia beads of 80 vol. %. Next, 1324 parts of a 65% ethyl acetate solution of the Low Molecular Weight Polyester 1 were added followed by two passes with the bead mill under the conditions described above to obtain a Pigment-Wax Dispersion 1. The solid concentration of the Pigment-Wax Dispersion 1 was 50%.

(Emulsification to Desolvation)

749 parts of the Pigment/Wax Dispersion 1, 115 parts of the Prepolymer 1 and 2.9 parts of the Ketimine Compound 1 were placed in a vessel, and after mixing for 2 minutes with a TK Homomixer (Tokushu Kika Kogyo Co., Ltd.) at 5000 rpm, 1200 parts of the Aqueous Phase 1 were added to the vessel followed by mixing for 10 minutes with the TK Homomixer at 13000 rpm to obtain an Emulsified Slurry 1.

The Emulsified Slurry 1 was placed in a vessel equipped with a stirrer and a thermometer and desolvated for 6 hours at 30° C. followed by aging for 5 hours at 45° C. to obtain a Dispersed Slurry 1.

(Washing to Drying)

100 parts of the Dispersed Slurry 1 were filtered under reduced pressure.

a) Next, 100 parts of ion exchange water were added to the filtration cake followed by mixing with the TK Homomixer (rotating speed: 12000 rpm, 10 minutes) and filtering.

b) 1% hydrochloric acid was added to the filtration cake of a) to control the pH to 3.5 to 4.5 followed by mixing with the TK Homomixer (rotating speed: 12000 rpm, 15 minutes) and filtering.

c) 300 parts by weight of ion exchange water were added to the filtration cake of b) followed by mixing with the TK Homomixer (rotating speed: 12000 rpm, 10 minutes) and filtering. This procedure was carried out twice to obtain a Filtration Cake 1.

d) The Filtration Cake 1 was dried for 40 hours with a circulating dryer at 40° C. and then passed through a sieve having a mesh size of 75 μm to obtain Toner Matrix Particles 1. Subsequently, 1.5 parts of hydrophobic silica and 0.5 parts of hydrophobic titanium oxide were added to 1100 parts of the Toner Matrix Particles 1 followed by mixing with a Henschel mixer and passing through a sieve having a mesh size of 35 μm to obtain a Toner 1. The physical properties of the resulting Toner 1 are shown in FIG. 17.

After having formulated the toner of the example described above as a developer, the toner was loaded into the printer 100 as claimed in the present embodiment and an initial running test was carried out in the manner described below to compare the cleaning device 30 of the present embodiment (FIG. 4) with a device of the prior art. A cleaning device 30 of the present embodiment in which a foreign object infiltration prevention member in the form of the foamed member 65*a* is attached to the support shaft 34 as in Example 1 was designated as an Example Device 1, while that in which foreign object storage means in the form of the foreign object storage groove 66 is provided in the support shaft 34 as in the modification was designated as an Example Device 2.

In addition, for the sake of comparison, testing of the device of the prior art was carried out under two conditions. Prior Art Device 1 was a cleaning device of the counter type as shown in FIG. 1B, the blade was made of a polyurethane rubber material having a JISA hardness of 70°, the blade was a cuboid having dimensions of T1=2.0 mm and T3=326 mm. This blade was attached to a blade holder with double-sided adhesive tape, and the blade length extending from the blade holder to the surface of the photosensitive element (free length: L) was 7.6 mm. The contact angle θ was set to 21.6° and the penetration depth was set to 1.0 mm. A Prior Art Device 2 was the same as the cleaning device of the present embodiment with the exception of not having a foreign object infiltration prevention member and foreign object storage means of the engaging portion.

Furthermore, the linear pressure was 0.788 N/cm. An organic photosensitive element was used for the photosensitive element 10.

A running test was carried out by interchanging only the example devices of the cleaning device 30 and the prior art devices described above with respect to the above-mentioned printer 100. In the running test, an A4-size pattern having an image area ratio of 5% was printed continuously followed by visual evaluations of removal performance (cleaning performance) and soiling of the bearing portion that supports the cleaning device after printing out 5,000 and 10,000 sheets, respectively. However, when a toner was evaluated as "x" in the overall visual evaluation, the initial running test was discontinued on that toner at the time of that evaluation.

During evaluation of cleaning performance, toner present on the photosensitive element after passing through the device following continuous printing of 100 sheets of a pattern having an image area ratio of 75% was transferred to Printac C Tape (Nitto Denko Corp.), and after affixing the tape to a piece of white paper, the paper was measured with a Model RD514 Macbeth Reflection Densitometer, and that for which the difference with a blank density was less than 0.010 was evaluated as "O", that in which the difference with the blank density was 0.011 to 0.02 was evaluated as "Δ", and that in which difference with the blank density exceeded 0.02 was evaluated as "X".

In addition, visual evaluation of soiling of the bearing portion that supports the cleaning device was carried out in the manner described below.

O: No toner or other foreign objects on bearing portion

Δ: Toner or other foreign objects observed on bearing portion, but not present to an extent that impairs the degree of freedom of the support shaft or does not have an effect on the cleaning device x: Toner or other foreign objects observed on bearing portion, and the foreign objects impair the degree of freedom of the support shaft and have an effect on the cleaning device The results of the running test are as shown in FIG. 18.

Cleaning performance of the Prior Art Device 1 was inferior. Although cleaning performance of the Prior Art Device 2 was favorable after printing 5,000 sheets, the bearing portion was soiled with toner, and after printing 10,000 sheets, the formation of thin lines was observed. In addition, toner had also collected in the bearing portion causing a decrease in the degree of freedom of the support shaft. On the other hand, in the case of using the Example Device 1, there was no decrease in cleaning performance or soiling of the bearing portion. In the case of using the Example Device 2, although soiling of the bearing portion was observed after printing 5,000 and 10,000 sheets, the degree of freedom of the support shaft was maintained and exacerbation of cleaning performance was not observed.

The running test explained here was carried out during the course of an initial running test. Moreover, there is a considerable possibility of the appearance of further performance differences as a result of carrying out testing in a long-term deterioration mode or running mode with the addition of environmental fluctuations.

According to the present embodiment as has been described thus far, the cleaning device 30 has a long, plate-shaped elastic member in the form of the blade 31, and a retaining member that retains the blade 31 in the form of the blade holder 32. In addition, the cleaning device 30 has an engaging member provided on the blade holder 32 in the form of the support shaft 34, and an engaged member that engages with the support shaft 34 and supported by the frame 33 of the device body in the form of the bearing 35. In addition, the cleaning device 30 is a counter-type cleaning device in which the support shaft 34 and the bearing 35 engage on the downstream side in the direction of surface movement of the photosensitive element 10, in the form of a surface moving member that is the target of cleaning, from the normal line N of the contact portion P contacted by the blade 31 on the surface of the photosensitive element 10. In addition, the cleaning device 30 employs a configuration provided with the holder horizontal portion 32A of the blade holder 32 that functions as warping restriction means for restricting warping of the blade 31 that occurs as a result of pressing the blade 31 against the surface of the photosensitive element 10, and the holder vertical portion 32B of the blade holder 32 that functions as a retaining member retains the blade 31 through the holder horizontal portion 32A. In addition, the cleaning device 30 removes adhered substances on the surface of the photosensitive element 10 by causing the blade 31 to press against the photosensitive element 10 such that one side of the blade 31 extending in the lengthwise direction thereof in the form of a contact edge is perpendicular to the direction of surface movement of the photosensitive element 10. The cleaning device 30 employs a configuration in which a degree of freedom is provided between the support shaft 34 and the bearing 35 by forming the gap G there between while the support shaft 34 and the bearing 35 are engaged such that the support shaft 34 and the bearing 35 engage with a degree of freedom that allows the blade holder 32 to be displaced relative to the device body. As a result of employing such a configuration, since the contact width of the blade 31 with respect to the surface of the photosensitive element can be shortened while still maintaining contact pressure comparable to the case of a cleaning device using a counter method of the prior art that employs a configuration in which warping of the blade 31 is not restricted as previously described, wear of photosensitive element 10 and the blade 31 can be inhibited, and the surface of the photosensitive element 10 can be favorably cleaned even when using a spherical toner having a small particle diameter while inhibiting fluttering of the blade 31.

In addition, in the case of employing a configuration that restricts warping of the blade 31, in the case of the cleaning device described in the Japanese Patent Application Laid-open No. 2008-096965, the blade 31 was no longer able to maintain the contact status in the lengthwise direction of the blade 31 with the surface of the photosensitive element 10 depending on tolerance attributable to assembly of each member or eccentricity of the photosensitive element 10 over time, and there was the risk of the occurrence of locations on the surface of the photosensitive element 10 that were not cleaned favorably. However, in the cleaning device 30 of the present embodiment, since the bearing 35 and the support shaft 34 engage with a degree of freedom due to the presence of the gap G at the engaging portion, and the blade holder 32 is able to be displaced relative to the frame 33 of the device body, the contact status between the blade 31 and the photosensitive element 10 in the lengthwise direction as described above can be maintained over time by correcting the above-mentioned tolerance. Accordingly, the appearance of locations on the surface of the photosensitive element 10 where cleaning cannot be carried out favorably can be inhibited. In addition, a prescribed contact pressure that is applied to the surface of the photosensitive element 10 from the blade 31 can be uniformly applied in the above-mentioned lengthwise direction.

At this time, since there is the possibility of the blade holder 32 being unable to be displaced relative to the photosensitive element if toner or other foreign objects enter the gap G at the engaging portion, the cleaning devices 30 of Example 1 and Example 2 have foreign object infiltration prevention means in the form of a foreign object infiltration prevention member in the bearing 35 or the support shaft 34 of the engaging portion. As a result, loss of the effects of the gap G attributable to the accumulation of foreign objects in the gap G can be prevented, thereby enabling the degree of freedom in the engaging portion between the support shaft 34 and the bearing 35, which is able to be obtained due to the gap G, to be stably maintained over time. As a result, the occurrence of uneven contact in the lengthwise direction of the blade 31 can be stably inhibited over time. Since the contact status between the blade 31 and the surface of the photosensitive element 10 is maintained over time, the appearance of locations on the surface of the photosensitive element 10 that are unable to be cleaned favorably can be inhibited. Accordingly, the cleaning device 30 of the present embodiment allows the obtaining of a high level of removal performance while reducing wear between the blade 31 and the cleaning target in the form of the photosensitive element 10, while also being able to stably maintain the contact status between the blade 31 and the photosensitive element 10 over time.

In particular, the cleaning device 30 of Example 1 prevents soiling of the gap G with foreign objects between the support shaft 34 and the bearing 35 inexpensively by providing a foreign object infiltration prevention member in the form of the foamed member 65*a* on the support shaft 34. In addition, the load during movement by the support shaft 34 relative to the bearing 35 is also reduced by the presence of the foamed member 65*a*. Consequently, both the gap G and cleaning performance are maintained over time without imparting hardly any load to the blade 31 that carries out cleaning.

In particular, the cleaning device 30 of Example 2 prevents soiling of the gap G with foreign objects between the support shaft 34 and the bearing 35 inexpensively by providing a foreign object infiltration prevention member in the form of the sheet member 65*b* on the bearing 35. In addition, since the sheet member 65*b* is thin, it can be installed even in confined spaces, and the load during movement of the bearing shaft 34 relative to the bearing 35 is reduced. Consequently, the gap G and cleaning performance are maintained over time without imparting hardly any load to the blade 31 that carries out cleaning.

In addition, the cleaning device 30 of the modification employs a configuration in which foreign object storage means, which ensures degree of freedom, in the form of the foreign object storage groove 66 is provided in the support shaft 34 in order to store foreign objects that have entered the gap G so that the blade holder 32 can be displaced relative to the photosensitive element 10 even if foreign objects have entered. As a result, the degree of freedom of the engaging portion is maintained over time by reducing impairment of the degree of freedom of the engaging portion attributable to foreign objects by providing a space for storing foreign objects even if foreign objects have entered the gap G. As a result, the blade 31 can be allowed to contact the photosensitive element 10 without the occurrence of partial contact there between even in the case of a cleaning device 30 in which the free length of the blade 31 is nearly zero for which even contact with the photosensitive element 10 is difficult. Accordingly, cleaning performance is maintained over time.

In addition, in the cleaning device 30 of the present embodiment, the engaging means is the support shaft 34, the engaged means is the bearing 35 having a round hole 38 formed in a circular shape as shown in FIG. 7, and the bearing 35 and the support shaft 34 engage with a degree of freedom in the radial direction of the support shaft 34. In other words, since the round hole 38 serving as a shaft hole of the bearing 35 is in the form of a clearance hole having a size to a degree that allows absorption of variations in member accuracy or mounting position accuracy with respect to the diameter of the support shaft 34, or positional shifts and the like on the support shaft side when ensuring uniform contact pressure with the photosensitive element 10, shifts relative to position of the photosensitive element 10 in the direction of the tangent M or the normal line N and the like can be accommodated.

In addition, the cleaning device 30 may also have the slot 39, which has a long axis in a direction roughly parallel to the direction of the normal line N of the contact portion P as shown in FIG. 8, for the bearing 35 of the cleaning device 30. As a result, the bearing 35 and the support shaft 34 engage with a degree of freedom in the direction of the long axis of the slot 39 of the bearing 35. In other words, the slot 39 parallel to the direction of the normal line N is used for the shaft hole of the bearing 35, and the slot 39 has a length of a degree that allows absorption of all variations in member accuracy or mounting position accuracy with respect to the diameter of the support shaft 34, or all positional shifts and the like on the support shaft side when ensuring uniform contact pressure with the photosensitive element 10, as positional shifts in a direction parallel to the normal line N. As a result, shifts in position of the contact portion P in the direction of the tangent M or the direction of the normal line N and the like can be accommodated. In addition, since the support shaft 34 is always located on the edge (wall) of the slot 39 with respect to the direction of the tangent M, movement (vibration) of the support shaft 34 attributable to driving of the photosensitive element 10 can be inhibited.

In addition, as shown in FIG. 4, a configuration may be employed for the blade 31 of the cleaning device 30 such that an angle formed by the two adjacent surfaces bordering on the contact edge is an obtuse angle. By making the shape of the blade 31 to have an obtuse angle, the contact surface area between the blade 31 and the photosensitive element 10 is reduced, thereby enabling the blade 31 to press against the photosensitive element 10 at a high surface pressure, leading to improvement of cleaning performance. In addition, as a result of the blade 31 having the shape of an obtuse angle, unstable sticking and slipping movement of the blade 31 can be inhibited, thereby reducing fatigue fracture of the blade 31 while also reducing blade wear.

In addition, in the cleaning device 30 of the present embodiment among two adjacent surfaces located on both sides of the contact edge in the direction in which the blade 31 is perpendicular to the contact edge as shown in FIG. 4, the length in the direction perpendicular to the contact edge of the upstream side surface 31*a* located on the upstream side in the direction of surface movement of the photosensitive element is longer than the length of the downstream side surface 31*b* located on the downstream side in the direction of surface movement of the photosensitive element 10. The holder horizontal portion 32A of the blade holder 32, which is warping restriction means for restricting warping of the blade 31 so that the upstream side surface 31*a* extends in the direction perpendicular to the contact edge and the opposing surface (surface on the back side of the blade 31) of the upstream side surface 31*a* shrinks, adheres to the opposing surface of the upstream side surface 31*a* of the blade 31 and enables the blade holder 32 to retain the blade 31. In a counter type of cleaning device of the prior art as shown in FIG. 1B, among the cleaning blade upstream side surface 231*a* and the cleaning blade downstream side surface 231*b* of the cleaning blade 231, which are adjacent to each other along the contact edge, the length in the direction perpendicular to the contact edge is shorter for the cleaning blade upstream side surface 231*a* than the cleaning blade downstream side surface 231*b*.

In addition, in the cleaning device 30 of the present embodiment, the holder horizontal portion 32A of the warping restriction means in the form of the blade holder 32 is configured such that the end on the side approaching the surface of the photosensitive element 10 is located at the same position or roughly the same position as the boundary edge with the downstream side surface 31*b* of the opposing surface of the upstream side surface 31*a* of the blade 31.

In addition, the cleaning device 30 of the present embodiment has an urging member in the form of the spring 36 that enhances pressing force in the direction of the normal line N of the contact portion P on the surface of the photosensitive element 10 to which pressing force is applied by the blade 31. In other words, the spring 36 is provided on the back end of the force application holder 37 on the normal line N of the contact portion P such that pressing force is applied to the blade holder 32 from the direction of the normal line N of the contact portion P. As a result, with pressing force being applied without causing any loss on the contact side of the blade 31, even if play (degree of freedom) is given to the engaging portion of the support shaft 34 and the bearing 35, pressing force can be uniformly applied in the above-mentioned lengthwise direction.

In addition, the printer 100 of the present embodiment is removably configured in the main body of an image forming apparatus such as the printer 100 that ultimately transfers images formed on the photosensitive element 10 to a recording material, and at least uses the process cartridge 121 that integrally supports the photosensitive element 10 and cleaning means for removing unnecessary adhered substances adhered to the photosensitive element 10 in the form of the cleaning device 30 of the present invention. As a result, in addition to the effects of cleaning device 30 as previously described, since the positional accuracy of the blade 31 and the photosensitive element 10 can be favorably maintained during assembly in the apparatus body, and the cleaning device 30 can be integrally replaced with the photosensitive element 10, maintenance can be carried out easily, such as enabling a user to easily replace the cleaning device 30 while easily maintaining positional accuracy.

In addition, since the printer 100 of the present embodiment is an image forming apparatus in which images formed on the photosensitive element 10 are ultimately transferred to a recording material, and is provided with cleaning means in the form of the cleaning device 30 for cleaning the photosensitive element 10, the cleaning device 30 is able to obtain effects like those described above, thereby enabling the photosensitive element 10 to be cleaned favorably and allowing the formation of images of high image quality.

Furthermore, although the previous explanation of the present embodiment used the example of the cleaning device 30 for the photosensitive element 10, the present invention can not only be used as the printer 100 of the present embodiment, but can also be used as cleaning device for a surface moving member in a so-called image forming apparatus. Thus, the present invention can also be applied to, for example, an image forming apparatus that has a single photosensitive element and a plurality (for example, 4 colors) of developing devices, generates each color of toner image on the photosensitive element by sequentially rotating each developing device, and ultimately forms images by transferring the toner images to a transfer paper, and can also be applied to monochromatic image forming apparatus. In addition, the present invention is not limited to a printer, but rather can also be used as a cleaning device of a photocopier, facsimile machine or combination machine having multiple functions. Furthermore, the image forming apparatus may be of the electronic photography type, the ink jet type or other types, and as long as the image forming apparatus is that provided with a surface moving member that requires adhered substances adhered to the surface thereof to be removed, the cleaning device of the present invention can be applied as a cleaning device for that surface moving member. In addition, the present invention can be similarly applied even if the adhered substance to be removed is a liquid such as a developing solution in addition to all types of powders such as toner, paper shreds and metal fragments.

In addition, the present invention can not only be applied to a cleaning device for a photosensitive element, but can also be applied to a cleaning device for removing adhered substances such as residual transfer toner that has adhered to the surface of a surface moving member other than a photosensitive element such as the intermediate transfer belt 162. In addition, the present invention can also be applied to a cleaning device for removing adhered substances such as toner or paper shreds adhered to the surface of not only an image carrier in the manner of a photosensitive element or intermediate transfer belt, but also a recording material transport member that transports a recording material by carrying the recording material on the surface thereof. Furthermore, the present invention can also be applied to a cleaning device of a recording material transport unit that integrally supports a recording material transport member and a cleaning device thereof.

In addition, the present invention can be applied to a cleaning device for all types of surface moving members that require adhered substances to be removed from the surface thereof. Naturally, the surface moving member may be in the form of a drum, belt or any other form provided it is a member having a moving surface. However, in the case of a cleaning device for a belt type of surface moving member, although the cleaning device is generally arranged between support rollers that support the belt and a blade so as be positioned on both sides of the belt, the cleaning device may also be arranged by arranging a backup member such as a flat member on the side of the inner peripheral surface of the belt so as to be positioned on both sides of the belt between the backup member and the blade. In addition, in the case the target of cleaning is the photosensitive element 10 as in the present embodiment, the photosensitive element may be an organic photosensitive element, an amorphous silicone-based photosensitive element, or photosensitive element in which a protective layer composed of a binder resin having a crosslinked structure is provided on the surface of an organic photosensitive element, and the present invention can be applied as a cleaning device for all types of photosensitive elements. In the case the cleaning target is the intermediate transfer belt 162, the intermediate transfer belt may be a polyimide-based intermediate transfer belt in consideration of heat resistance and stretchability, an intermediate transfer belt using a polyethylene-based material or a fluorine-based or rubber-based intermediate transfer belt, and the present invention can be applied as a cleaning device for all types of intermediate transfer belts.

Furthermore, in the various application examples explained here, the configuration of the cleaning device 30 for a photosensitive element explained in the above-mentioned embodiment can be used nearly as is, or can be used after suitably modifying according to the particular application example.

In the cleaning device of the present invention as previously described, engaging means and engaged means engage with a degree of freedom due to the presence of a gap while in the engaged state, thereby enabling a retaining member to be displayed relative to the device body. Consequently, as a result of the retaining member being displaced relative to the device body, shifts in the positional relationships between each member caused assembly tolerances of each member or environmental fluctuations can be corrected, thereby making it possible to maintain contact between a surface moving member and a plate-shaped elastic member.

In particular, by having foreign object infiltration prevention means for preventing entry of foreign objects into the gap between the engaging means the engaged means, loss of the effects of the gap attributable to the accumulation of foreign objects in the gap can be prevented, thereby making it possible to stably maintain the degree of freedom in the engagement of the engaging means the engaged means, which is able to be obtained due to the presence of the gap, over time.

In addition, by providing foreign object storage means for storing foreign objects that have entered the gap between the engaging means and the engaged means and ensures the degree of freedom in the engagement between the engaging means and the engaged means, in particular, loss of the effects of the gap attributable to accumulation of foreign objects in the gap as described above can be prevented, thereby making it possible to stably maintain the degree of freedom in the engagement of the engaging means the engaged means, which is able to be obtained due to the presence of the gap, over time.

Thus, in the cleaning device of the present invention, the occurrence of uneven contact in the lengthwise direction of a plate-shaped elastic member can be stably inhibited over time. Since contact between a plate-shaped elastic member and a surface moving member can be maintained over time, the appearance of locations on the surface of the surface moving member that are unable to be cleaned favorably can be inhibited.

According to the present invention as described above, the present invention demonstrates superior effects consisting of allowing the obtaining of a high degree of removal performance while reducing wear between a plate-shaped elastic member and a cleaning target in the form of a surface moving member, and being able to stably maintain contact between the surface moving member and the plate-shaped elastic member over time.

Various modifications will become possible for those skilled in the art after receiving the teachings of the present disclosure without departing from the scope thereof.

What is claimed is:

1. A cleaning device that removes adhered substances on a surface of a surface moving member, comprising:

a long, plate-shaped elastic member;

a retaining member that retains the plate-shaped elastic member;

a support shaft provided on the retaining member;

a bearing that engages with the support shaft, the bearing being supported by a device body, and the bearing including a hole that provides a gap between the support shaft and the bearing, so that the support shaft is shiftable within a cross section of the hole and the gap is shiftable within the cross section of the hole to both a top end and a bottom end of the hole;

a warping restriction member that restricts warping of the plate-shaped elastic member that occurs as a result of the plate-shaped elastic member pressing against the surface of the surface moving member; and a foreign object infiltration prevention member that prevents entry of foreign objects into the gap between the support shaft and the bearing in any position that the support shaft shifts to within the cross section of the hole, wherein the support shaft and the bearing engage downstream in a direction of surface movement of the surface moving member from a line normal to a portion of the surface of the surface moving member in contact with the plate-shaped elastic member, the retaining member retains the plate-shaped elastic member through the warping restriction member, and the plate-shaped elastic member removes adhered substances on the surface of the surface moving member by pressing against the surface of the surface moving member, with the plate-shaped elastic member being pressed against the surface of the surface moving member such that one side of the plate-shaped elastic member extending in a lengthwise direction thereof is perpendicular to a direction of surface movement of the surface moving member, and a degree of freedom is provided between the support shaft and the bearing by the gap therebetween being maintained free from foreign objects by the foreign object infiltration prevention member while the support shaft and the bearing are engaged, so that the degree of freedom enables the retaining member to be displaced relative to the device body.

2. The cleaning device as claimed in claim 1, wherein the foreign object infiltration prevention member is a foamed member provided on the support shaft or the bearing.

3. The cleaning device as claimed in claim 1, wherein the foreign object infiltration prevention member is a sheet member provided on the support shaft or the bearing.

4. The cleaning device as claimed in claim 3, wherein the sheet member has an umbrella-shape in which the central portion thereof protrudes towards the retaining member.

5. The cleaning device as claimed in claim 1, wherein the surface moving member includes at least one of an image carrier and a recording material transport member.

6. The cleaning device as claimed in claim 1, wherein the hole is cylindrical opening, and the support shaft and the bearing engage with the degree of freedom in a radial direction of the cylindrical opening.

7. The cleaning device as claimed in claim 1, wherein the hole is slot having a long axis in a direction roughly parallel to the normal line, and the support shaft and the bearing engage with the degree of freedom in the direction of the long axis of the slot.

8. The cleaning device as claimed in claim 1, wherein an angle formed by two adjacent surfaces of the plate-shaped elastic member that meet along a contact edge of the plate-shaped elastic member is an obtuse angle.

9. The cleaning device as claimed in claim 8, wherein the obtuse angle is in a range of 95° to 140°, inclusive.

10. The cleaning device as claimed in claim 1, further comprising:

an urging member that enhances pressing force, in a direction substantially parallel to the normal line, that is applied from the plate-shaped elastic member to the surface of the surface moving member.

11. The cleaning device as claimed in claim 1, further comprising:

a brush roller that contacts the surface of the surface moving member upstream in a direction against surface movement of the surface moving member from the normal line.

12. The cleaning device as claimed in claim 1, wherein a contact angle of a side of the plate-shaped elastic member having a contact edge in contact with the surface of the surface moving member, the side being downstream in the direction of surface movement of the surface moving member from the normal line, relative to a tangent to the surface of the surface moving member at the contact edge and extending in the direction of surface movement, is in a range of 5° to 50°, inclusive.

13. A process cartridge configured removably with respect to a body of an image forming apparatus that ultimately transfers an image formed on an image carrier, which is a surface moving member, to a recording material, and integrally supports at least the image carrier and a cleaning device that removes unnecessary substances adhered to a surface of the surface moving member, the cleaning device comprising:

a long, plate-shaped elastic member;

a retaining member that retains the plate-shaped elastic member;

a support shaft provided on the retaining member;

a bearing that with the support shaft, the bearing being supported by a device body, and the bearing including a hole that provides a gap between the support shaft and the bearing, so that the support shaft is shiftable within a cross section of the hole and the gap is shiftable within the cross section of the hole to both a top end and a bottom end of the hole;

a warping restriction member that restricts warping of the plate-shaped elastic member that occurs as a result of the plate-shaped elastic member pressing against the surface of the surface moving member; and a foreign object infiltration prevention member that prevents entry of foreign objects into the gap between the support shaft and the bearing in any position that the support shaft shifts to within the cross section of the hole, wherein the support shaft and the bearing engage downstream in a direction of surface movement of the surface moving member from a line normal to a portion of the surface of the surface moving member in contact with the plate-shaped elastic member, the retaining member retains the plate-shaped elastic member through the warping restriction member, and the plate-shaped elastic member removes adhered substances on the surface of the surface moving member by pressing against the surface of the surface moving member, with the plate-shaped elastic member being pressed against the surface of the surface moving member such that one side of the plate-shaped elastic member extending in a lengthwise direction thereof is perpendicular to a direction of surface movement of the surface moving member, and a degree of freedom is provided between the support shaft and the bearing by the gap therebetween being maintained free from foreign objects by the foreign object infiltration prevention member while the support shaft and the bearing are engaged, so that the degree of freedom enables the retaining member to be displaced relative to the device body.

14. An image forming apparatus that ultimately transfers an image formed on a surface of a surface moving member to a recording material, and is provided with a cleaning device for removing substances adhered to the surface of the surface moving member, the cleaning device comprising:

a long, plate-shaped elastic member;

a retaining member that retains the plate-shaped elastic member;

a support shaft provided on the retaining member;

a bearing that with the support shaft, the bearing being supported by a device body, and the bearing including a hole that provides a gap between the support shaft and the bearing, so that the support shaft is shiftable within a cross section of the hole and the gap is shiftable within the cross section of the hole to both a top end and a bottom end of the hole;

a warping restriction member that restricts warping of the plate-shaped elastic member that occurs as a result of the plate-shaped elastic member pressing against the surface of the surface moving member; and a foreign object infiltration prevention member that prevents entry of foreign objects into the gap between the support shaft and the bearing in any position that the support shaft shifts to within the cross section of the hole, wherein the support shaft and the bearing means engage downstream in a direction of surface movement of the surface moving member from a line normal to a portion of the surface of the surface moving member in contact with the plate-shaped elastic member, the retaining member retains the plate-shaped elastic member through the warping restriction member, and the plate-shaped elastic member removes adhered substances on the surface of the surface moving member by pressing against the surface of the surface moving member, with the plate-shaped elastic member being pressed against the surface of the surface moving member such that one side of the plate-shaped elastic member extending in a lengthwise direction thereof is perpendicular to a direction of surface movement of the surface moving member, and a degree of freedom is provided between the support shaft and the bearing by the gap therebetween being maintained free from foreign objects by the foreign object infiltration prevention member while the support shaft and the bearing are engaged, so that the degree of freedom enables the retaining member to be displaced relative to the device body.

15. The image forming apparatus as claimed in claim 14, wherein the surface moving member includes at least one of an image carrier and a recording material transport member.

16. The image forming apparatus as claimed in claim 15, wherein at least one of a process cartridge and a recording material transport unit is provided that is integrally configured with the cleaning device and configured removably with respect to the image forming apparatus body.

17. The image forming apparatus as claimed in claim 16, wherein a toner having at least one of a volume average particle diameter of 3 to 7 μm, an average roundness of 0.940 to 0.998, and shape factors SF-1 and SF-2 of 100 to 160, is used as the toner that forms the image.

18. The image forming apparatus as claimed in claim 16, wherein a toner obtained by dissolving and/or dispersing in an organic solvent a toner composition containing a polyester prepolymer having a functional group containing a nitrogen atom, a polyester, a colorant and a mold release agent to produce an organic solvent composition, then dispersing the organic solvent composition in an aqueous medium in which resin fine particles are present, and carrying out a crosslinking and/or elongation reaction, is used as the toner that forms the image.

* * * * *